US006511145B1

(12) United States Patent
Tsuboi et al.

(10) Patent No.: US 6,511,145 B1
(45) Date of Patent: Jan. 28, 2003

(54) METHOD FOR ADJUSTING AN AMOUNT OF DISCHARGE BETWEEN A PLURALITY OF LIQUID DISCHARGE NOZZLE UNITS, AN INK JET DRIVING METHOD USING SUCH METHOD OF ADJUSTMENT, AND AN INK JET APPARATUS

(75) Inventors: Hitoshi Tsuboi, Tokyo (JP); Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/883,575

(22) Filed: Jun. 26, 1997

(30) Foreign Application Priority Data

Jun. 28, 1996 (JP) ..... 8-170310

(51) Int. Cl.[7] ..... B41J 29/38
(52) U.S. Cl. ..... 347/14; 347/11
(58) Field of Search ..... 347/10, 11, 15, 347/14, 17, 57, 60, 19, 12

(56) References Cited

U.S. PATENT DOCUMENTS 4,251,824 A 2/1981 Hara et al.
5,142,374 A 8/1992 Tajika et al. ..... 358/298
5,300,968 A 4/1994 Hawkins
5,343,231 A * 8/1994 Suzuki ..... 347/14
5,353,052 A * 10/1994 Suzuki et al. ..... 347/19
5,661,514 A * 8/1997 Lukis et al. ..... 347/211
5,754,201 A * 5/1998 Ishinaga et al. ..... 347/62
5,815,173 A * 9/1998 Silverbrook ..... 347/15
5,917,509 A * 6/1999 Becerra et al. ..... 347/11
6,325,492 B1 * 12/2001 Koitabashi et al. ..... 347/57

FOREIGN PATENT DOCUMENTS

EP 605207 * 7/1994 ..... 347/17
JP 6-31919 * 2/1994 ..... 347/15

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A method for adjusting an amount of discharge is to adjust the amount of liquid between liquid discharge units to discharge the liquid by driving a plurality of electrothermal transducing elements, which uses a plurality of liquid discharge units arranged corresponding to each liquid path for the creation of air bubbles for discharging the liquid, at the same time, being arranged to be capable of being driven individually. This method comprises the step of variably controlling the starting time of driving signal applied to each of the electrothermal transducing elements for the creation of air bubbles in each of the discharge units. The variable control thereof makes it possible to suppress the variation of discharge amount of liquid between the liquid discharge units, hence maintaining the amount of liquid discharged from each of the discharging units at a constant level to obtain printed images of higher quality.

11 Claims, 14 Drawing Sheets

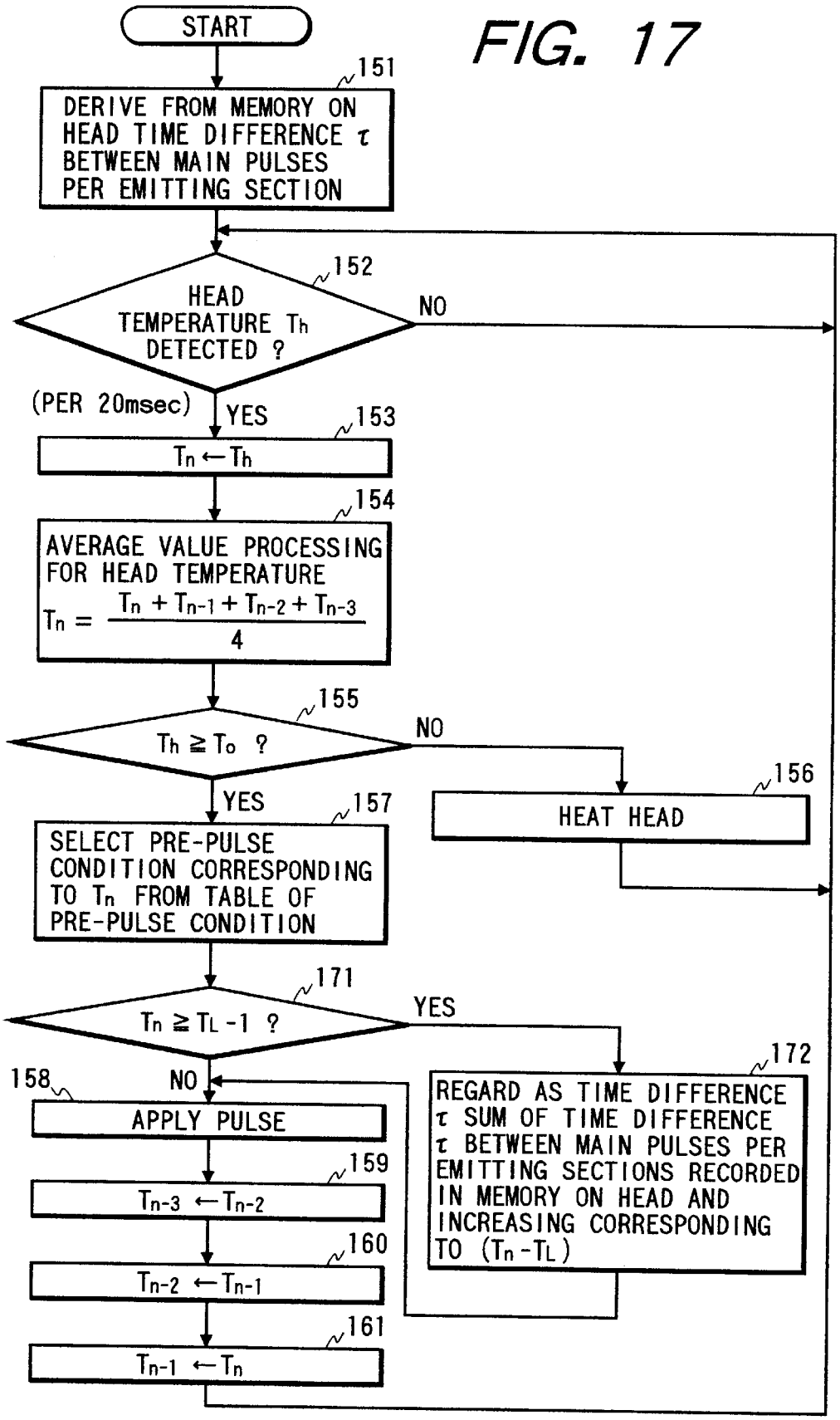
FIG. 17
START
151
DERIVE FROM MEMORY ON HEAD TIME DIFFERENCE τ BETWEEN MAIN PULSES PER EMITTING SECTION
152
HEAD TEMPERATURE Th DETECTED ?
NO
(PER 20msec)
YES
153
Tn ← Th
154
AVERAGE VALUE PROCESSING FOR HEAD TEMPERATURE
Tn = (Tn + Tn-1 + Tn-2 + Tn-3) / 4
155
Th ≧ To ?
NO
156
HEAT HEAD
YES
157
SELECT PRE-PULSE CONDITION CORRESPONDING TO Tn FROM TABLE OF PRE-PULSE CONDITION
171
Tn ≧ TL -1 ?
YES
172
REGARD AS TIME DIFFERENCE τ SUM OF TIME DIFFERENCE τ BETWEEN MAIN PULSES PER EMITTING SECTIONS RECORDED IN MEMORY ON HEAD AND INCREASING CORRESPONDING TO (Tn -TL)
158
NO
APPLY PULSE
159
Tn-3 ← Tn-2
160
Tn-2 ← Tn-1
161
Tn-1 ← Tn

METHOD FOR ADJUSTING AN AMOUNT OF DISCHARGE BETWEEN A PLURALITY OF LIQUID DISCHARGE NOZZLE UNITS, AN INK JET DRIVING METHOD USING SUCH METHOD OF ADJUSTMENT, AND AN INK JET APPARATUS

BACKGROUND OF THE INVENTION

1. Field of the Invention

The present invention relates to a method for adjusting an amount of discharge to equalize amounts of discharges from a plurality of liquid discharge units, an ink jet apparatus for discharging ink droplets from the ink discharge nozzles, and a method for driving an ink jet head used for the ink jet apparatus. More particularly, the invention relates to a method for driving an ink jet head provided with a plurality of heat generating elements for air bubble creation, each in the ink liquid path corresponding to each of the ink discharge nozzles, for discharging ink by the creation of air bubbles by the application of heat. The invention also relates to an ink jet apparatus using such ink jet head.

2. Related Background Art

The ink jet apparatus is well known as one mode of a recording apparatus, such as a printer, a copying machine. Of the apparatuses, the ink jet recording apparatus which uses a discharge method, whereby air bubbles are created by causing thermal energy to act upon ink or other liquid, and to discharge ink from the ink discharge ports by a discharge force following the creation of air bubbles, has been getting more popular rapidly in recent years. As another use of the ink jet apparatus using a discharge method of this kind, an ink jet textile printing apparatus is also well known. This apparatus prints specific patterns, designs, synthetic images, or the like on cloths.

For the conventional ink jet apparatuses including the ink jet textile printing apparatus, there are some cases where the amount of discharge may vary due to changes in temperature, or when a plurality of ink discharge nozzles are used for discharging ink, the amount of discharge varies between discharge nozzles, and an uneven recording (an uneven printing) may take place. Several methods have been proposed and practically in use for the suppression of the uneven recording that may be caused by changes in temperature and the variation of discharge amount between discharge nozzles.

Now, among ink jet recording apparatuses, the one, which is provided with heat generating elements for the creation of air bubbles by means of heat generated by such elements, and which discharges ink by such creation of air bubbles, tends to allow part of thermal energy applied to the creation of air bubbles to cause the temperature of the ink jet head (discharge head) to rise. As a result, the amount of discharge may vary due to the resultant rise of environmental temperature, and the temperature of the head itself as well. This variation of discharge amount is brought about by changes in ink viscosity, and also, changes in the facility of air bubble creation caused by changes in the temperature of ink. Consequently, for example, the head temperature increases as the recording operation progresses, thus leading to the varied amount of discharges. Then, a problem is encountered that the quality of images changes. In this respect, therefore, a proposal has been made to enable an ink jet apparatus of the kind to control not only the discharge amounts by adjusting over all temperatures, but also, to devise a method for utilizing thermal energy more effectively for the creation of air bubbles.

When electrothermal transducing elements are used as heat generating elements, the width of applied pulses is changed for the creation of air bubbles or before the application of main pulses for the air bubble creation, a pre-pulse is applied in the temporal width that is not intensive enough to create any air bubbles, and then, the discharge amount is controlled by changing the width of the pre-pulse, and the quiescent time between the pre-pulse and the main pulse. Also, a proposal has been made to adopt a control of the discharge amount of the kind for the suppression of the variation per discharge nozzle.

However, in accordance with the conventional method for controlling the discharge amount described above, the changeable range of the discharge amount is not large enough, and if the rate of printing duty is continuously high, the temperature of ink jet head is caused to rise considerably. Therefore, it becomes necessary to secure a sufficient margin for the discharge nozzles to execute control to suppress the variation of discharge amount. This marginal arrangement automatically restricts the effective use of those proposed methods, and even makes it difficult in some cases to control the variation of discharge amount caused by changes in temperature and the variation between discharge nozzles sufficiently.

It is an object of the present invention to provide a new method for adjusting an amount of discharge to equalize the discharge amounts between a plurality of liquid discharge units, and at the same time, to provide an ink jet apparatus provided with electrothermal transducing elements as heat generating elements to create air bubbles for discharging, which is capable of securing a sufficiently wide controllable range for controlling the discharge amount constantly even when one or both of variations of the discharge amount are great due to the variation of discharge amount caused by changes in temperature of ink and head or caused by the individual difference of a particular discharge nozzle or the nozzle group. It is also the object of the invention to provide a method for driving the ink jet head for such ink jet apparatus.

SUMMARY OF THE INVENTION

The method for adjusting an amount of discharge of the present invention mainly comprises the step of adjusting the amount of liquid between each of liquid discharge units for discharging the liquid by driving a plurality of electrothermal transducing elements by use of a plurality of liquid discharge units, which are arranged corresponding to each liquid path to create air bubbles for discharging the liquid, and at the same time, arranged to be capable of being driven individually. This method is to control the discharge amount of liquid between each of the liquid discharge units by variably controlling the starting time of driving signal applied to each of the electrothermal transducing elements in each discharge unit between each of the liquid discharge units for suppressing the variation of discharge amount of liquid between each of the liquid discharge units.

The method for driving an ink jet head of the present invention mainly comprises a step of driving a plurality of electrothermal transducing elements together by providing a plurality of discharge nozzles having a plurality of electrothermal transducing elements arranged to create air bubbles for discharging ink, and at the same time, arranged to be capable of being driven individually. This method is provided with a first control to apply driving signals, each formed by the main pulse to generate thermal energy for the creation of air bubbles; the pre-pulse preceding the main pulse for heating but not intensive enough to create any air bubbles; and the quiescent time between the main pulse and the pre-pulse, such driving signals being applied to the plural electrothermal transducing elements in order to change each driving signal itself. This method is also provided with a second control to shift the application timing of the main pulse to be applied to the plural electrothermal transducing elements in the discharge nozzles, and then, to suppress the variation of discharge amount caused by changes in the temperature of ink by means of either one of the first and second controls, as well as to suppress the variation of discharge amount between the discharge nozzles by means of the other one of the first control and the second control.

Also, for such method for driving an ink jet head, either one of the first control and the second control is performed when the temperature detected from the head is within a range up to a specific target temperature in order to suppress the variation of discharge amount caused by changes in temperature, and the other one of the first control and the second control is performed to suppress the variation of discharge amount caused by the individual difference between discharge nozzles or between discharge nozzle groups. When the detected temperature exceeds the target temperature, the first and second controls are combined to suppress the variation of discharge amount caused by changes in the temperature of ink.

Or with the provision of plural discharge nozzles having a plurality of electrothermal transducing elements arranged to create air bubbles for discharging ink, and at the same time, arranged to be capable of being driven individually, it is made possible for a method for driving an ink jet head to drive such plurality of electrothermal transducing elements together to discharge ink, and then, to suppress the variation of liquid discharge amount between each of the liquid discharge units by variably controlling the starting time of application of signals to each of the electrothermal transducing elements in the nozzles for creating air bubbles.

Also, the ink jet apparatus of the present invention mainly comprises an ink jet head provided with plural nozzles having a plurality of electrothermal transducing elements arranged to create air bubbles for discharging ink, and at the same time, arranged to be capable of being driven individually, and arranged to discharge ink by driving such plurality of electrothermal transducing elements together. This ink jet apparatus comprises temperature detection means for detecting temperatures of the ink jet head; data storing means for storing correction data to correct the variation of discharge amount between discharge nozzles or between discharge nozzle groups; driving means for applying driving signals, each formed by the main pulse to enable each of the electrothermal transducing elements to generate thermal energy per discharge nozzle for the creation of air bubbles, the pre-pulse preceding the main pulse for heating but not intensive enough to create any air bubbles, and the quiescent time between the main pulse and the pre-pulse, in accordance with recording data; and controlling means for performing a first control to change the conditions of the pre-pulse application in accordance with the data stored in the data storing means, and also, performing a second control to shift the application timing of the main pulses between electrothermal transducing elements per discharge nozzle.

Or an ink jet apparatus comprises an ink jet head provided with plural nozzles having a plurality of electrothermal transducing elements arranged to create air bubbles for discharging ink, and at the same time, arranged to be capable of being driven individually, and arranged to discharge ink by driving such plurality of electrothermal transducing elements together. This ink jet apparatus comprises temperature detection means for detecting temperatures of the ink jet head; data storing means for storing correction data to correct the variation of discharge amount between discharge nozzles or between discharge nozzle groups; driving means for applying driving signals to enable each of the electrothermal transducing elements to generate thermal energy for the creation of air bubbles per discharge nozzle in accordance with recording data; and controlling means for performing a control to shift the application timing of the driving signal between the electrothermal transducing elements per discharge nozzle or discharge nozzle group in accordance with the result of detection of the temperature detection means, and the data stored in the data storing means as well.

With the provision of a plurality of electrothermal transducing elements for the creation of air bubbles in each liquid path for each nozzle that comprises the discharge port and the liquid path conductively connected therewith (typically, an ink path), it is possible to shift the timing of the air bubble creation on each of the electrothermal transducing elements by shifting the application timing of the main pulses to be applied to these electrothermal transducing elements for the creation of air bubbles, that is, at least one kind of time differential $\tau$ is set with respect to the application timing of the main pulses to such plurality of electrothermal transducing elements. In this way, the timing of air bubble creation on each of the electrothermal transducing elements is allowed to shift, hence making it possible to change the discharge amount of each discharge port. More specifically, if the main pulses are applied at a time (that is, the time differential $\tau$ is set at 0), the discharge amount becomes maximum as described later, and the larger the time differential $\tau$ when applying the main pulses to each of the electrothermal transducing elements, the more is the discharge amount reduced. Here, for the present invention, using this time differential $\tau$ it is intended to control the discharge amount for the stabilization thereof. In this way, the discharge amounts are equalized between a plurality of liquid discharge units or between discharge nozzles.

Particularly, for the discharge amount control with respect to an ink jet head, the pre-pulse control and the control by means of the time differential $\tau$ are combined for use, and typically, one of these controls is applied to suppressing the variation of discharge amount caused by changes in the temperature of ink, and the other one of them is applied to suppressing the variation of discharge amount caused by the individual difference between discharge nozzles (discharge nozzle groups). In this way, even if either one or both of the variation of ink temperature and the individual difference between discharge nozzles (discharge nozzle groups) are so large that a sufficiently controllable range cannot be obtained just by either one of them, it becomes possible to secure a wide controllable range by the combined use of both of them.

BRIEF DESCRIPTION OF THE DRAWINGS

FIG. 17 is a flow chart which illustrates the discharge amount control in accordance with a fifth embodiment of the present invention.

DETAILED DESCRIPTION OF THE PREFERRED EMBODIMENTS

Hereinafter, with reference to the accompanying drawings, the description will be made of the embodiments in accordance with the present invention.

First Embodiment

Figure 1:
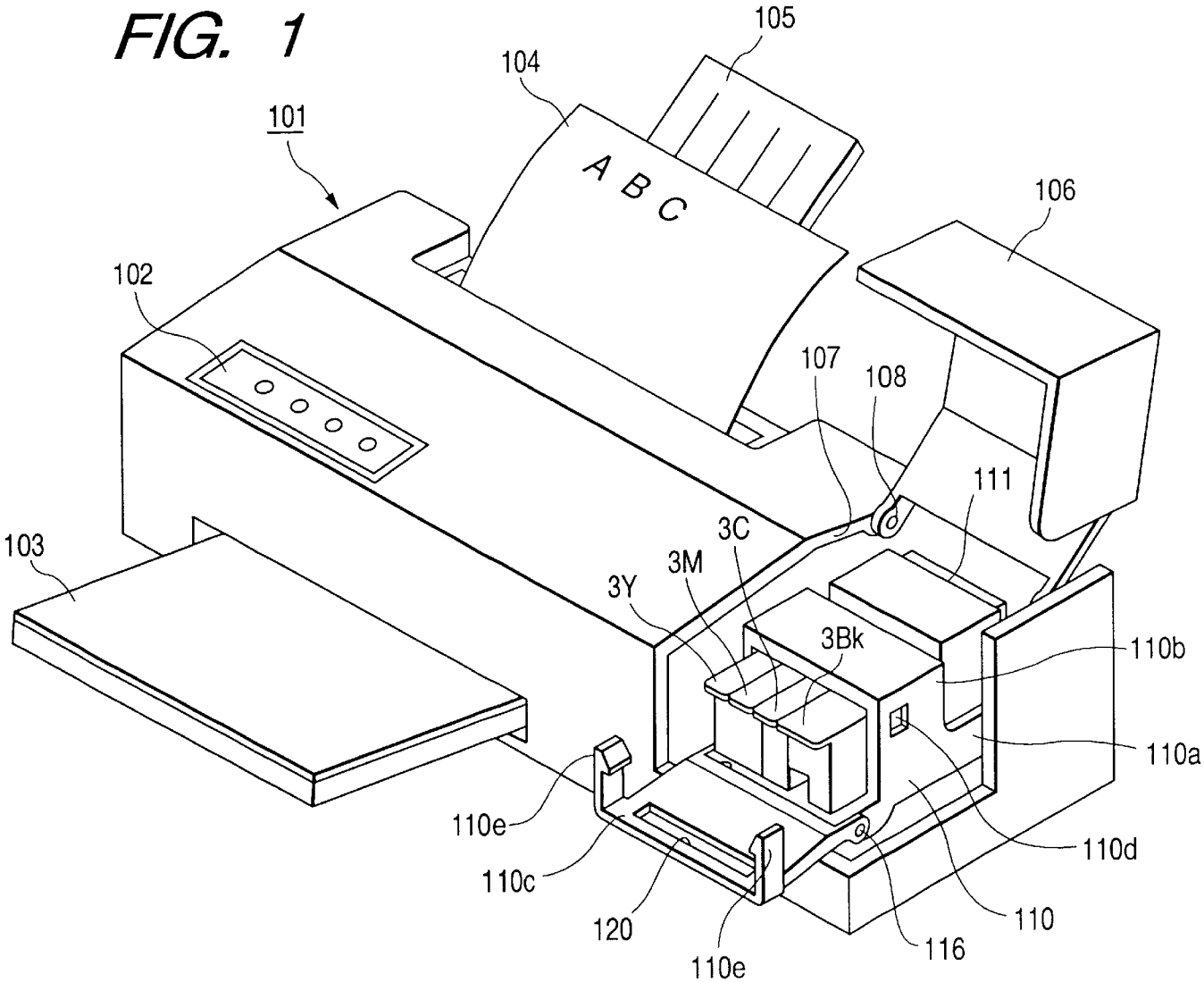
FIG. 1 is a perspective view which shows an ink jet recording apparatus in accordance with one embodiment of the present invention.

FIG. 1 is a perspective view which shows a printer (an ink jet recording apparatus) serving as an ink jet apparatus in accordance with a first embodiment of the present invention.

On the upper front of the housing of the printer 101, an operation panel 102 is arranged. Also, on the front aperture of the housing of the printer 101, a sheet feeding cassette 103 is mounted. A sheet 104 serving as a recording medium is supplied from this sheet feeding cassette 103, and exhausted to an exhausted sheet tray 105 through the sheet carrier path in the printer 101. Also, on the portion of the printer 101 on the right-hand side in FIG. 1, an apparatus cover 106 is arranged, having the sectional shape thereof being in the L-letter form. The apparatus cover 106 is arranged to cover the aperture 107 formed on the right front portion of the printer 101, and rotatively fixed to the inner end of the aperture 107 by means of a hinge 108. Also, inside the housing, there is arranged a carriage 110 supported by a guide or the like (not shown). The carriage 110 is arranged to be able to reciprocate in the width direction of the sheet 104 (hereinafter referred to as the main scanning direction), which is being carried through the sheet carrier path described above.

The carriage 110 of the present invention comprises a stage 110*a* horizontally supported by a guide or the like; an aperture (not shown) arranged behind and on the stage 110*a* through which an ink jet head is mounted; a cartridge garage for housing each of the color ink cartridges 3Y, 3M, 3C and 3Bk, which are detachably mounted on the stage 110*a* through the aforesaid aperture; and a cartridge holder 110*c* arranged to be open and closed with respect to the cartridge garage 110*b*, and to prevent the ink cartridges thus housed from falling off. The ink cartridges 3Y, 3M, 3C and 3Bk retain each of the corresponding color ink to be supplied to each of the ink jet heads to be described later.

The stage 110*a* is slidably supported by the guide on its rear portion, and at the same time, the lower front end side thereof is arranged to slidably engage with a guide plate (not shown). Here, this guide plate may be the one that functions as a sheet pressure member to prevent the sheet 104 from floating while it is being carried on the sheet carrier path described above or may be the one that functions to hold the stage in a cantilever fashion with respect to the guide depending on the thickness of a sheet.

On the aperture of the stage 110*a*, each ink jet head (not shown in FIG. 1) is mounted on it with the ink discharge ports being directed downwardly. Here, each of the ink jet heads is provided corresponding to each color ink.

The cartridge garage 110*b* is provided with a penetrating aperture in the depth direction of the housing in order to house the four ink cartridges 3Y, 3M, 3C and 3Bk at a time, and on both sides of the outer side thereof, a coupling recess is formed to allow each of the coupling nails of the cartridge holder 110*c* to engage with such recess, respectively.

On the front end of the stage 110*a*, the cartridge holder 110*c* is rotatively fixed by means of a hinge 116. The dimension from the front end of the garage 110*b* to the hinge 116 is determined in consideration of the dimension and others of the protruded portion from the front end of the garage 110*b* when the ink cartridges 3Y, 3M, 3C and 3Bk are housed in the garage 110*b*. The cartridge holder 110*c* is in the form of a flat plate shaped almost in rectangle. On the cartridge holder 110*c*, a pair of coupling nails 110*e* are arranged on the upper portions-of both sides of the holder, which are away from its lower part fixed by means of the hinge 116. The nails protrude in the direction orthogonal to the plate surface, and also, engage with the coupling recesses 110*d* of the garage 110*b* when the cartridge holder 110*c* is closed. Further, on the cartridge holder 110*c*, a fitting hole 120 is formed on its plate portion so as to allow each of the gripping portions of the ink cartridges 3Y, 3M, 3C and 3Bk to be fitted into the hole. The fitting hole 120 is positioned, configured, and sized corresponding to the gripping portions described above.

Figure 2:
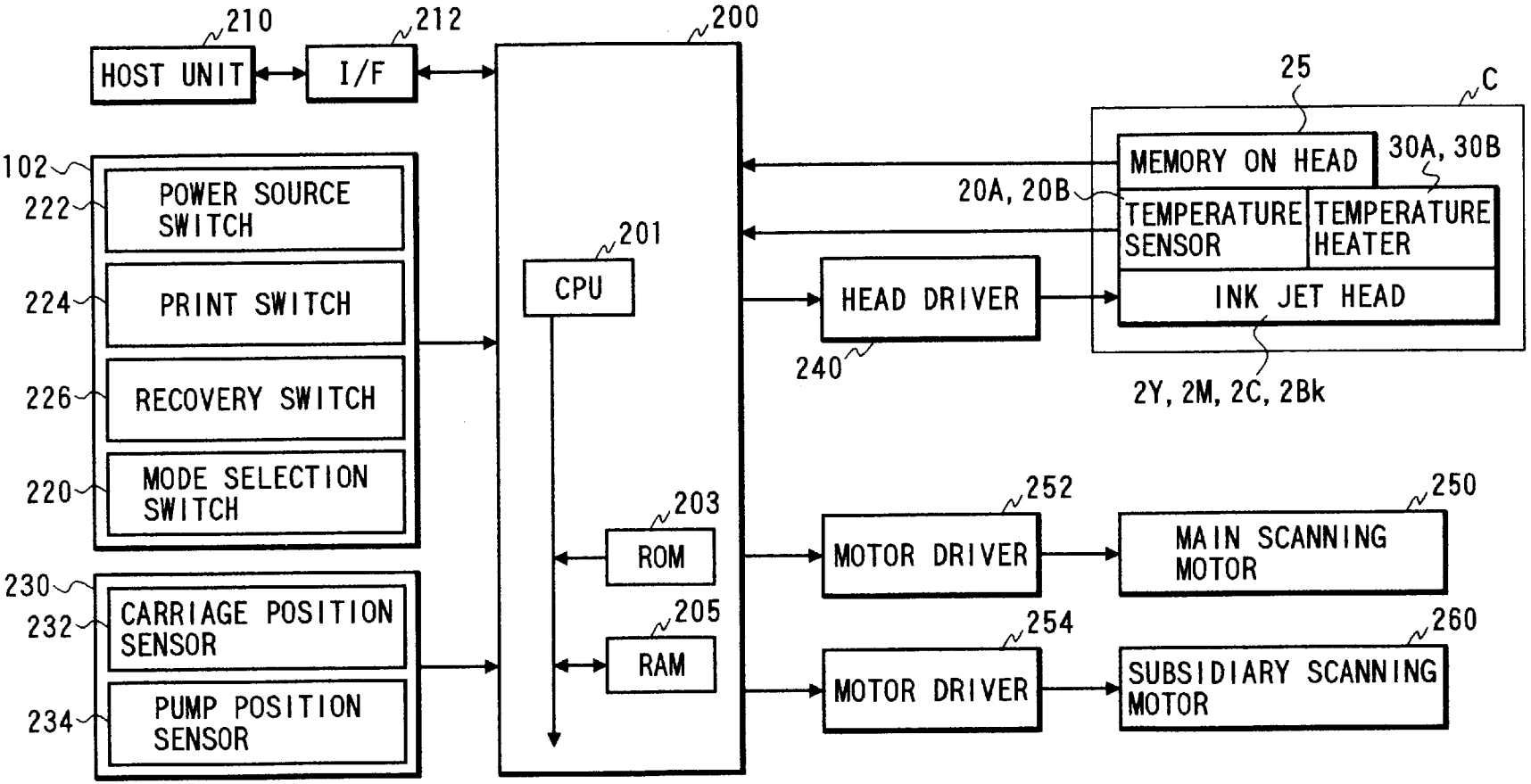
FIG. 2 is a block diagram which shows the structure of the principle control of the ink jet apparatus represented in FIG. 1.

FIG. 2 is a block diagram showing the structural example of the control systems of the ink jet printer described above.

Here, a controller 200 is the main control unit of the printer, which comprises a CPU 201 in the mode of microcomputer, for example, to execute various modes, which will be described later; a ROM 203 that stores programs and tables corresponding to the various execution sequences thereof, voltage of heat pulses, pulse widths, and other fixed data; and a RAM 205 having a region for the development of image data, working area, and others thereon. The controller 200 transmits and receives image data, other commands, status signals, or the like to and from an external host device (the device may be the reader unit that reads images) 210 serving as the supply source of image data through an interface (I/F) 212.

The operation panel 102 is provided with a group of switches for the operator to input instructions, such as a mode selection switch 220 for selecting various modes to be described later; a power-supply switch 222; a printing switch 224 to issue command on print-start; and a recovery switch 226 to issue command on the discharge recovery process, among some others. Also, in the printer 101, there are arranged sensors for detecting the current status of the apparatus as a sensor group 230, such as a carriage position sensor 232 to detect the home position, starting position, and others with respect to the carriage 110 (see FIG. 1); and a pump position sensor 234 that includes a leaf switch for use of detecting the pump positions. Here, the controller 200 receives the inputted instructions from the operation panel 102, and the detection results from the sensor group 230 as well.

In accordance with the present embodiment, color ink of yellow, magenta, cyan, and black are stored in the ink cartridges 3Y, 3M, 3C and 3Bk, respectively. These four colors of ink are supplied to the ink jet heads 2Y, 2M, 2C and 2Bk, respectively. Then, these are discharged onto a recording medium (paper sheet 204) from the ink jet heads 2Y, 2M, 2C and 2Bk in accordance with recording data. In order to drive the ink jet heads 2Y, 2M, 2C and 2Bk, a head driver 240 is provided. The head driver 240 drives electrothermal transducing elements (heaters) in each of the ink jet heads 2Y, 2M, 2C and 2Bk in accordance with the recording data and others from the controller 200. At the same time, the head driver is used for driving temperature heaters 30A and 30B for adjusting the temperatures of ink jet heads 2Y, 2M, 2C and 2Bk, respectively.

In accordance with the present embodiment, each of the ink jet heads 2Y, 2M, 2C and 2Bk for use of each color is structured on a chip element C by forming a plurality of discharge nozzles as described later. At the same time, the structure is made to arrange on the chip element C, the temperature heaters 30A and 30B for adjusting the temperature of each ink jet head; a memory 25 provided for the head to store information on difference in individual elements between discharge nozzles; and temperature sensors 20A and 20B for detecting head temperatures. Here, also, the controller 200 receives the detected values of temperatures from the temperature sensors 20A and 20B and data read out from the memory 25 on the head. The values of temperatures detected by the temperature sensors 20A and 20B are those of each head. However, it is safe to consider that these head temperatures indicate ink temperatures in each ink flow path substantially.

Further, this printer is provided with a main scanning motor 250 to enable the carriage 110 to travel in the main scanning direction; a sub-scanning motor 260 to carry a paper sheet 104 (see FIG. 1) serving as a recording medium in the sub-scanning direction, which is orthogonal to the main scanning direction; and motor drivers 252 and 254 to drive these motors 250 and 260.

Figure 3:
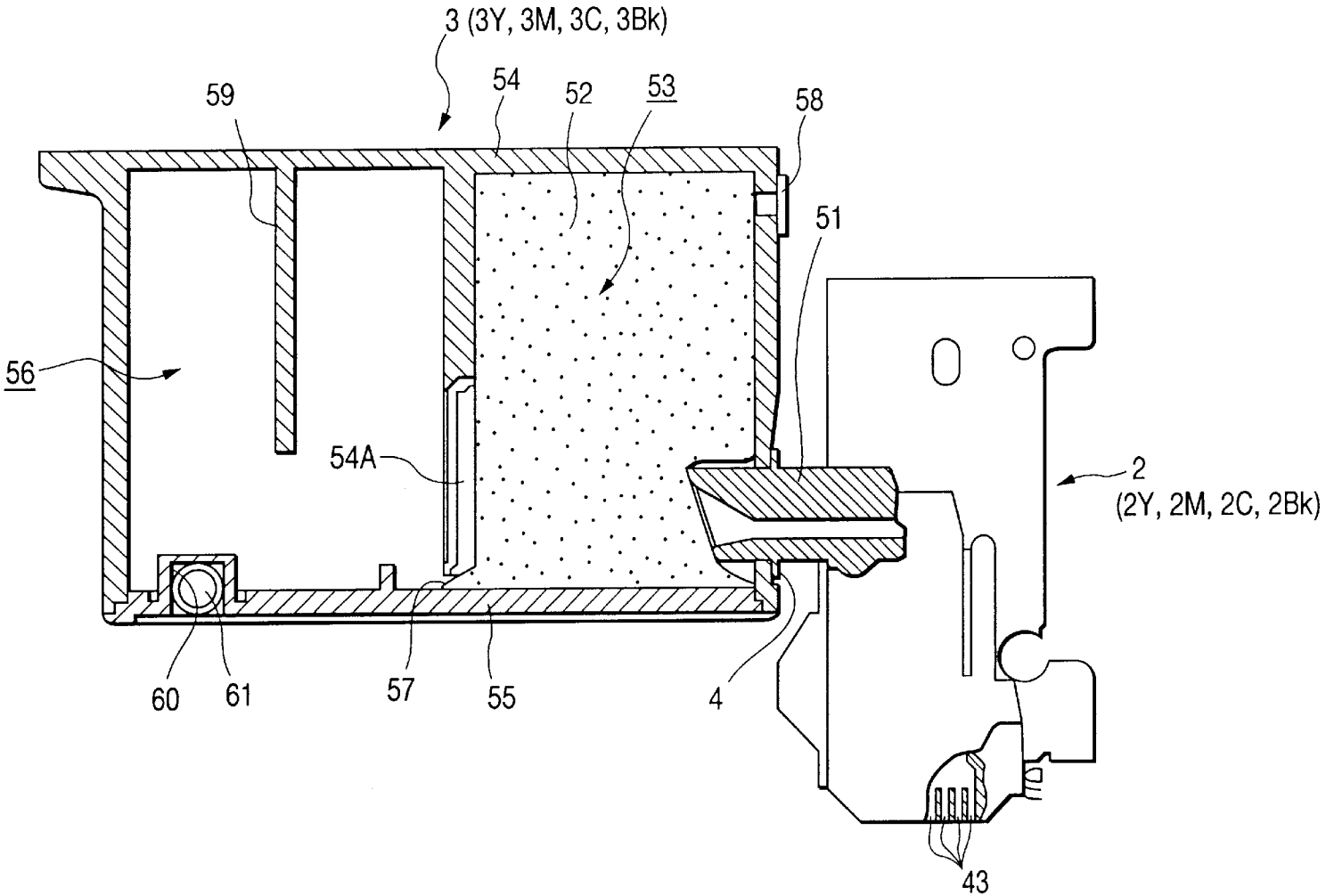
FIG. 3 is a cross-sectional view which shows the ink jet head and the ink cartridge used for the ink jet apparatus represented in FIG. 1.

FIG. 3 is a cross-sectional view which shows the ink cartridge 3 (ink cartridges 3Y, 3M, 3C and 3Bk) used for the ink jet printer described above, and the ink jet head 2 (ink jet heads 2Y, 2M, 2C and 2Bk) in a state of being connected.

Each ink cartridge 3 is provided with a chamber 53 for a negative pressure generating member, having an ink absorbent 52 filled in it; and an ink retaining chamber 56, having no ink absorbent in it. In the initial state, ink is retained in both of these two chambers. Along the ink discharge paths from each ink jet head 2 or the like, ink retained in the ink retaining chamber 56 is consumed at first.

Each of the ink jet heads 2 is provided with electrothermal transducing elements (heaters) to generate thermal energy utilized for discharging, each two of which are arranged for each of ink paths 42 corresponding to a plurality of ink discharge ports 43, and discharges ink supplied from each of the ink cartridges 3 through the corresponding connecting tube 4.

Figure 4A:
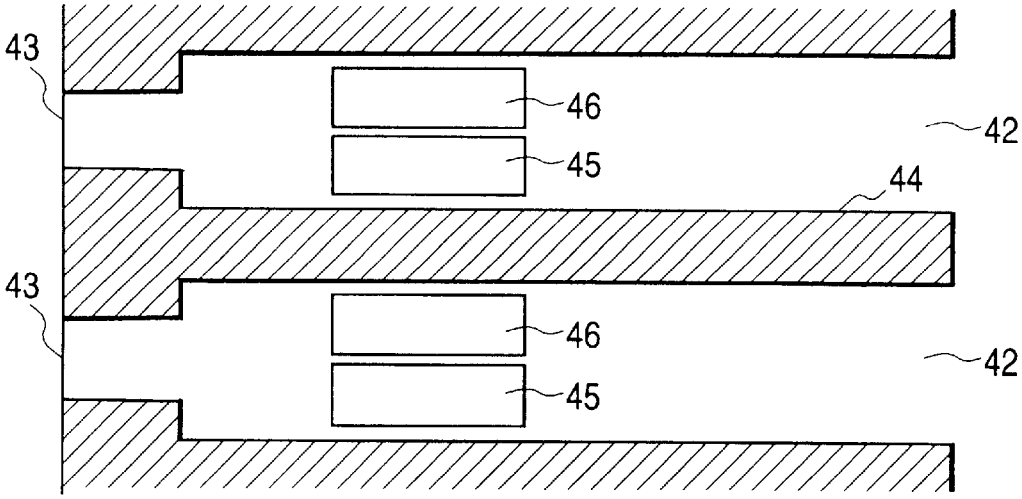
FIGS. 4A and 4B are cross-sectional views showing one structural example of an ink jet head used for each of the embodiments in accordance with the present invention.
Figure 4B:
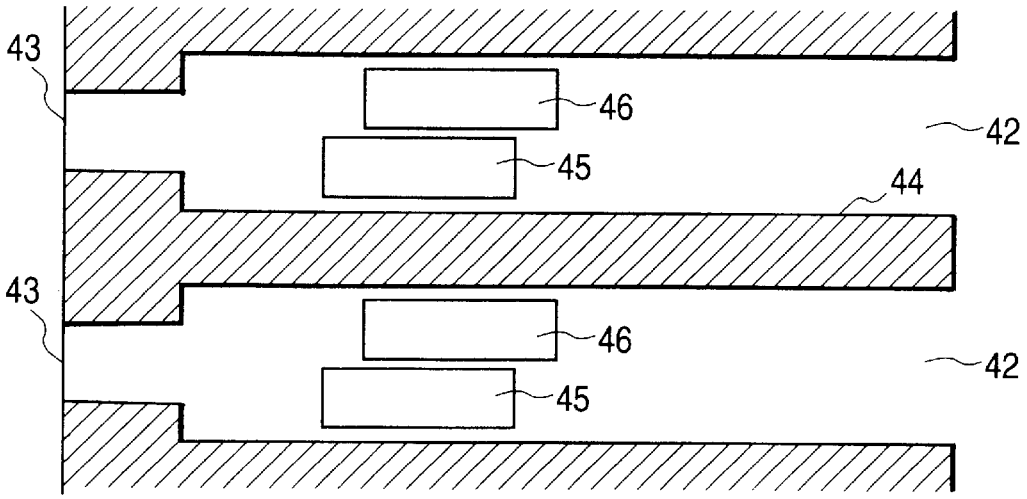

FIGS. 4A and 4B are cross-sectional views which schematically illustrate the structural example of such ink jet head 2, respectively. On the bottom of each ink path 42, two electrothermal transducing elements 45 and 46 are arranged as described above. As shown in FIG. 4A, the surface shape of the electrothermal transducing elements 45 and 46 is substantially rectangular. These elements are arranged in line in the direction orthogonal to the direction of ink flow in the ink path 42 (in the longitudinal direction of the ink path 42) in a broad way. Two electrothermal transducing elements 45 and 46 shown in FIG. 4B are also arranged in line side by side as in FIG. 4A, but in a staggered state if observed precisely, that is, a shift is arranged between them in the direction of the ink flow. For the present invention, a plurality of electrothermal transducing elements (typically, two of them) may be arranged side by side accurately as shown in FIG. 4A or may be arranged side by side but with a shift in the direction of ink flow within a range of the length of the electrothermal transducing element as shown in FIG. 4B.

Fundamentally, the electrothermal transducing elements 45 and 46 function satisfactorily irrespective of whether these are arranged as in FIG. 4A or as in FIG. 4B unless otherwise specified in the description given below.

For the present embodiment, the surface area of the two electrothermal transducing elements 45 and 46 may be the same or different. In this respect, the length of each of the electrothermal transducing elements 45 and 46 is fundamentally the same in the longitudinal direction of the ink path 42. If the surface areas should be made different, it may be possible to make the widths (each length in the direction orthogonal to the longitudinal direction of the ink path 42) different from each other. The wire electrodes and others (not shown) of the head driver 240 (see FIG. 1) are arranged so that each of the electrothermal transducing elements 45 and 46 can be driven separately and individually or simultaneously. On the leading end (left-hand side in FIGS. 4A and 4B) of each ink path 42, a discharge port 43 is open.

In accordance with the present embodiment, the unit structure of each discharge port, which comprises the electrothermal transducing elements 45 and 46, the discharge port 43, the ink path 42, and others, is arranged on one chip element in the density of 720 dpi (720 pieces per 25.4 mm), for example, in a specific number for the ink jet head 2. Each of the ink paths 42 is separated from each other by means of the liquid path wall 44. Then, on the end portion of each ink path 42, opposite to the discharge port 43 side, is conductively connected with a common liquid chamber (not shown) shared by each of the ink path 42 for use. Through this common liquid chamber, ink is supplied to each of the ink paths 42. Here, the aperture area of discharge port 43 and each of the electrothermal transducing elements 45 and 46 per unit are the same to each other between discharge port units.

Now, the description will be made of the recording operation by the ink jet head 2 structured as described above.

When the ink path 42 is filled with ink, electric pulse of a certain temporal width or more is applied to at least one of the electrothermal transducing elements 45 and 46 as driving signal. Then, the electrothermal transducing element thus energized generates heat. With this heat, an air bubble is created in part of ink (foaming). By the acting force exerted by this foaming, part of ink residing on the discharge port 43 side of the electrothermal transducing element is discharged from the discharge port 43 to fly in the direction toward the left-hand side in FIGS. 4A and 4B. After that, then, when the air bubble created on the electrothermal transducing element disappears by defoaming, ink is supplied from the common liquid chamber (not shown) arranged in the right-hand side in FIGS. 4A and 4B into the ink path 42 by means of capillary phenomenon. At this juncture, it is preferable to make an arrangement so that film boiling phenomenon is generated on the surface of the electrothermal transducing element. The voltage and temporal width of pulse are selected to make the generation of such film boiling phenomenon possible.

Now, the objective of the present invention is to make the amount of ink droplets constant when the droplets are discharged from each discharge port in accordance with the recording data even if the variation of the discharge amounts is large due to the variation of discharge amounts caused by changes in the temperature of ink or head, and also, by the individual difference in discharge nozzles or between the discharge nozzle groups. Therefore, in accordance with the present embodiment, the following controls are combined in order to control the discharge amount at a constant value:

1) The timing of the main pulses, which form the driving signals, is arranged to shift from each other when applied to the two electrothermal transducing elements 45 and 46 provided for each ink path 42.
2) By use of the temperature heaters 30A and 30B described above, each head is heated to a predetermined temperature.
3) Preceding the application of the main pulses, the pre-pulse is produced to be applied at least to one of the electrothermal transducing elements 45 and 46, which also forms the driving signal but not intensive enough to create any air bubbles, and then, the temporal width of such pre-pulse is made changeable.
4) It is arranged to change the interval (off time) between the pre-pulse and main pluses, which form the driving signals.

Here, the main pulse means the pulse which creates air bubbles in each of the ink path 42 when applied to cause ink to be discharged from each discharge port 43 by the acting force exerted by the creation of such air bubbles.

Now, hereinafter, the description will be made of the respective techniques of the discharge amount control used for the present embodiment.

For the ink jet head 2 described above, two electrothermal transducing elements 45 and 46 are arranged in each of the ink paths 42, and the main pulses are applied to both of the electrothermal transducing elements 45 and 46 for discharging ink droplets. At this juncture, the application timing of the main pulses for both of electrothermal transducing elements 45 and 46 is arranged to change in an order of micro seconds, for example. Then, it becomes possible to change the volume of ink droplets to be discharged from each discharge port 43 even if the temporal width and voltage of the main pulses are constant.

Figure 5:
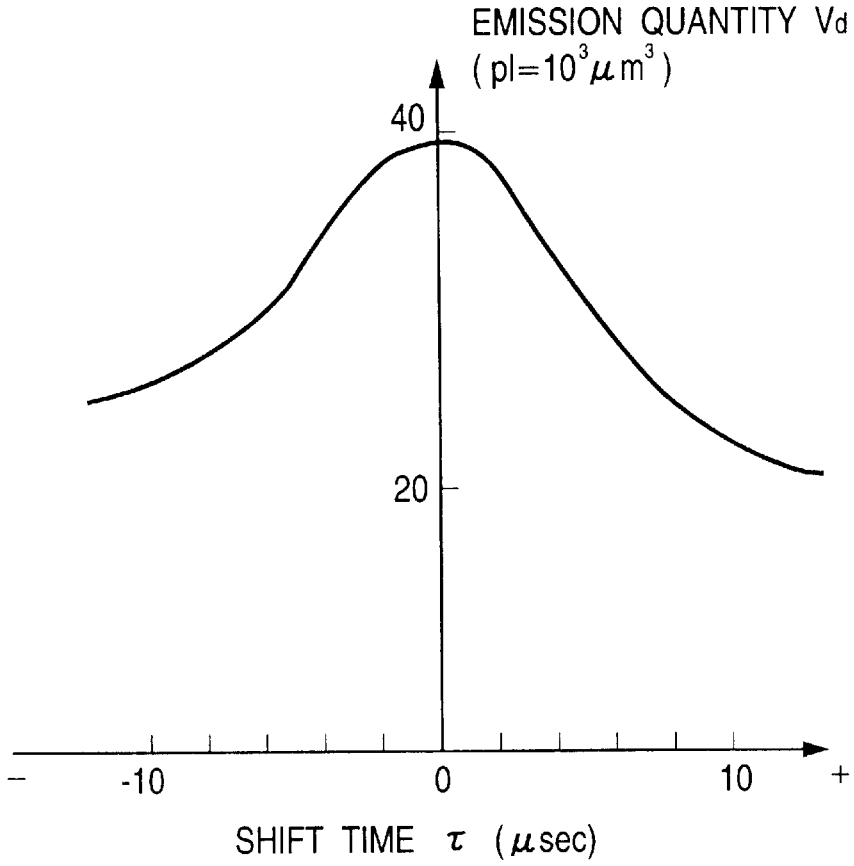
FIG. 5 is a graph which shows one example of the relationship between the time differential $\tau$ and the discharge amount $V_d$.

FIG. 5 is a graph which shows one example of the relationship between the time differential $\tau$ of the main pulses applied to the electrothermal transducing elements 45 and 46, and the discharge amount $V_d$ of the discharge port 43. As clear from this graph, it is possible to obtain the maximum discharge amount by applying the main pulses to the electrothermal transducing elements 45 and 46 almost simultaneously. The large the time differential between main pulses, the more the discharge amount is reduced. Therefore, it is understandable that the discharge amount is controllable by controlling the time differential $\tau$. If the surface areas of the electrothermal transducing elements 45 and 46 are the same, the relationship between the time differential $\tau$ and the discharge amount $V_d$ presents symmetry centering on $\tau=0$ (at the time of the discharge value $V_d$ becoming maximum) as far as the observation is made on the basis of a measured data obtainable by setting the measurement interval at 0.5 $\mu$s with the time differential $\tau$. Also, in a case where the positions of the electrothermal transducing elements 45 and 46 shift to each other in the direction of ink flow, the discharge amount $V_d$ becomes maximum at $\tau=0$, and it also indicates the tendency as represented in the graph shown in FIG. 5. For the present embodiment, when ink droplets are discharged from each of the discharge ports 43 in accordance with the recording data, it is arranged to apply main pulses to both of the electrothermal transducing elements 45 and 46, and then, the control of the discharge amount is carried out by changing the time differential $\tau$.

Now, the description will be made of the control of the discharge amount using pre-pulse. Before the main pulses (for use of air bubble creation) are applied, the pre-pulse whose pulse width is not intensive enough to create any air bubbles is applied to the electrothermal transducing elements 45 and 46. Ink residing in the vicinity of the electrothermal transducing elements 45 and 46 in the ink path 42 is then heated to make it easier to create air bubbles by the application of main pulses which follow. As a result, the discharge amount $V_d$ increases when the main pulses are applied.

Figure 6:
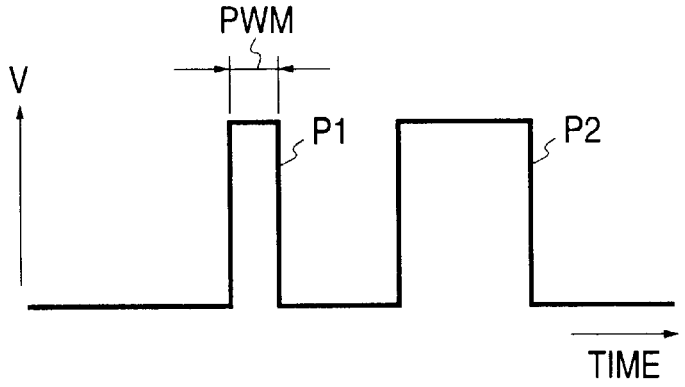
FIG. 6 is a view which shows the wave form that controls the pre-pulse for changing the temporal widths of off time.
Figure 7:
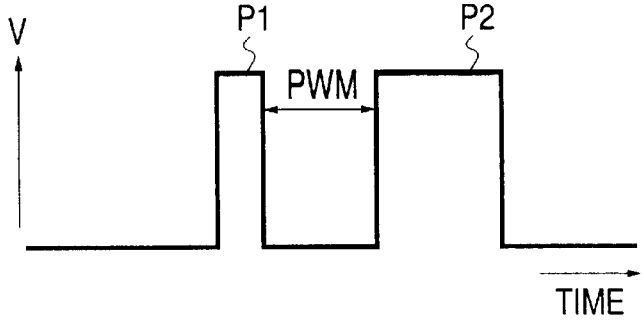
FIG. 7 is a view which shows the wave form that controls the pre-pulse for changing the lengths of off time.

FIG. 6 is a view which shows the temporal relationship between the pre-pulse P1 and the main pulse P2. This relationship indicates that the discharge amount is controllable by changing the temporal width of the pre-pulse. Likewise, in FIG. 7, it is shown that the discharge amount is controllable by changing the quiescent time between the pre-pulse P1 and the main pulse P2, that is, by changing the length of off time between them. Here, changing the width of pre-pulse or the length of off time is termed as a PWM control.

For the present embodiment, by the combination of the heating by means of the temperature heaters 30A and 30B, and the control of discharge amount by the application of pre-pulse, the control of the discharge amount is implemented with respect to changes in the head temperature. Then, by changing the setting of the time differential $\tau$ described above, correction is made with respect to the variation of discharge amount caused by the individual difference between discharge nozzles. For the present embodiment and each of the embodiments to follow, the control of the discharge amount is carried out based on the head temperatures. However, since the temperatures of head and ink are closely related, the execution of control by means of head temperatures essentially means the control executed on the basis of the ink temperatures.

Figure 8:
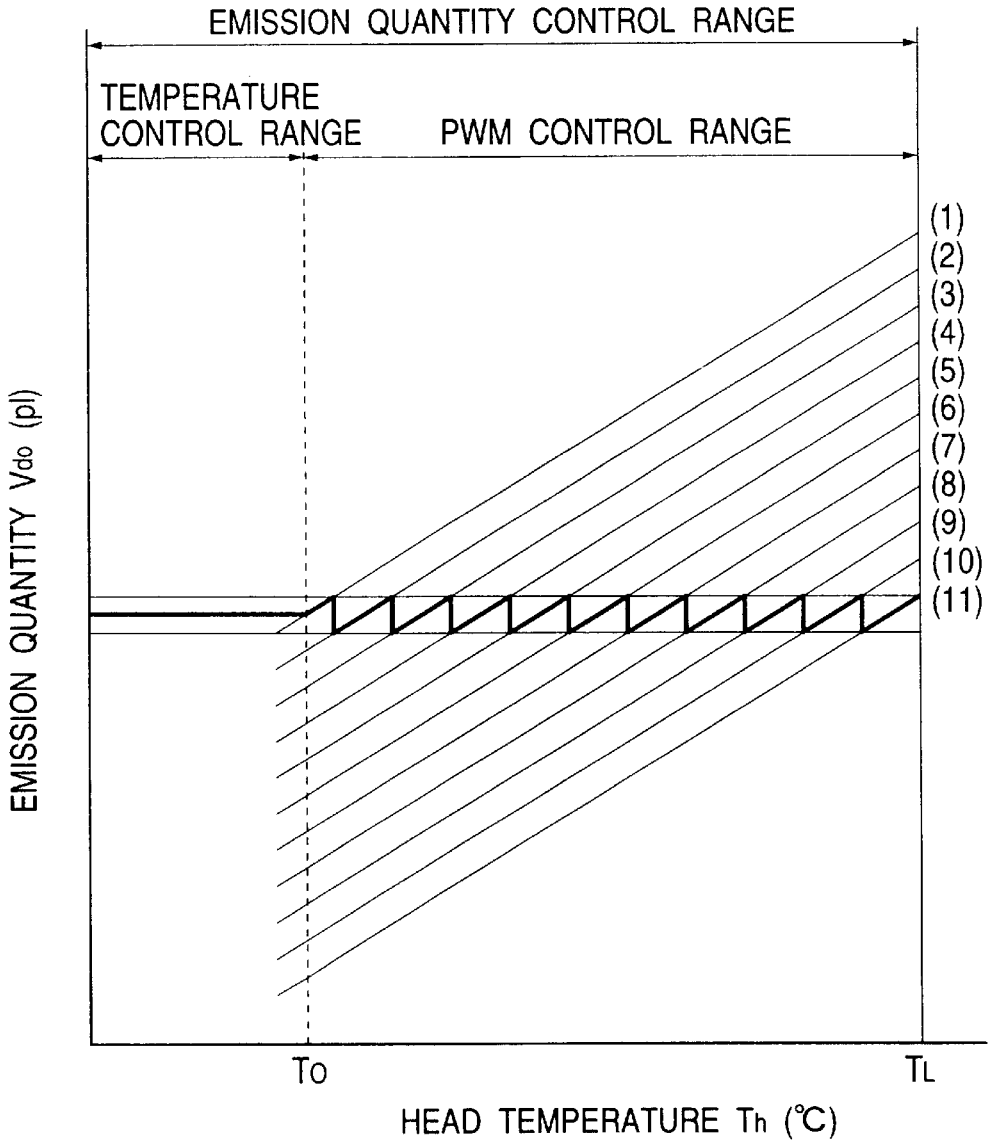
FIG. 8 is a graph which illustrates the discharge amount control with respect to the head temperatures in accordance with the first embodiment of the present invention.

FIG. 8 is a view which illustrates the control of discharge amount with respect to changes in the head temperature. Given the target temperature of the temperature adjustment by means of the temperature heaters 30A and 30B as $T_o$, it is assumed that the adjustment of head temperature is executed by heat generated by the temperature heaters 30A and 30B within the range up to the temperature $T_o$ ("temperature adjustment range" indicated in FIG. 8). Also, in FIG. 8, each of the straight lines designated by numerals (1) to (11) indicates the relationship between the head temperature and the discharge amount from the discharge port 43, provided that the pre-pulse condition is constant, and it corresponds to the pre-pulse condition having a larger discharge amount in order of the smaller number. Here, therefore, the pre-pulse conditions are switched over to meet the head temperatures in order to keep the variation of the discharge amount within a specific width as indicated by thick lines in FIG. 8. More specifically, a table indicating the pre-pulse conditions applicable to each specific range of head temperatures is stored on the ROM 203 in the controller 200 of the printer or stored in a driver software provided for the operation of this ink jet printer.

Now, the description will be made of the correction of the variation of discharge amount between discharge nozzles.

As a method for suppressing the variation of discharge amount caused by the individual difference between discharge nozzles, it has been generally in practice for the conventional art that while securing the processing precision at the time of manufacture, no particular control is executed to suppress the variation at the time of driving; the head is designed to keep its temperature uniformly; or only a simple control of temperatures is executed to obtain a uniform temperature if any control is carried out at the time of driving. There is also an example in which a pre-pulse control is executed to suppress the variation of the discharge amounts between discharge nozzles, but it often fails to carry out the control satisfactorily as anticipated, because a load is too heavy in executing the control of discharge amounts with respect to changes in temperature. Also, just by means of pre-pulse control, it is intended to cope with such situations as being caused by two factors that result in the varied amount of discharge, that is, the one brought about by the variation between discharge nozzles and the other by changes in temperatures. This makes the intended control extremely complicated.

Figure 9A:
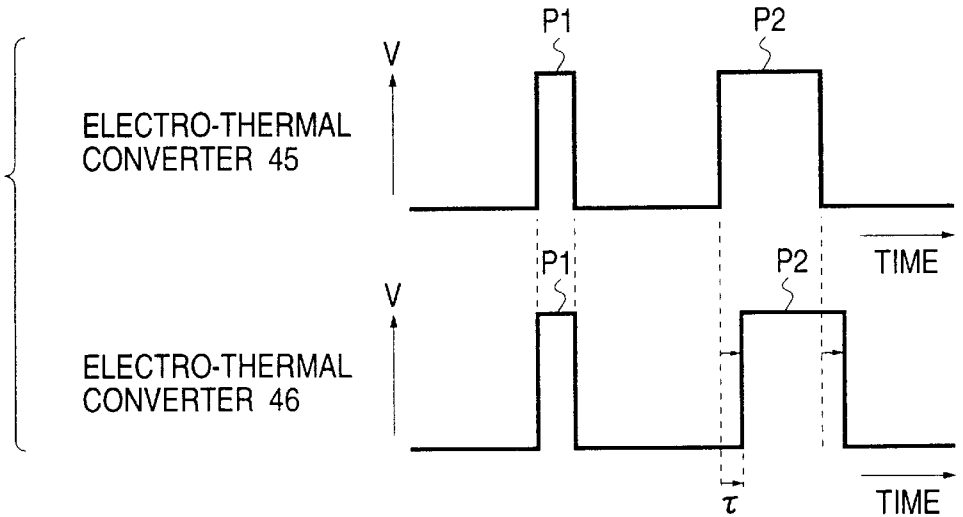
FIGS. 9A and 9B are views showing the wave forms which illustrate the time differential $\tau$.
Figure 9B:
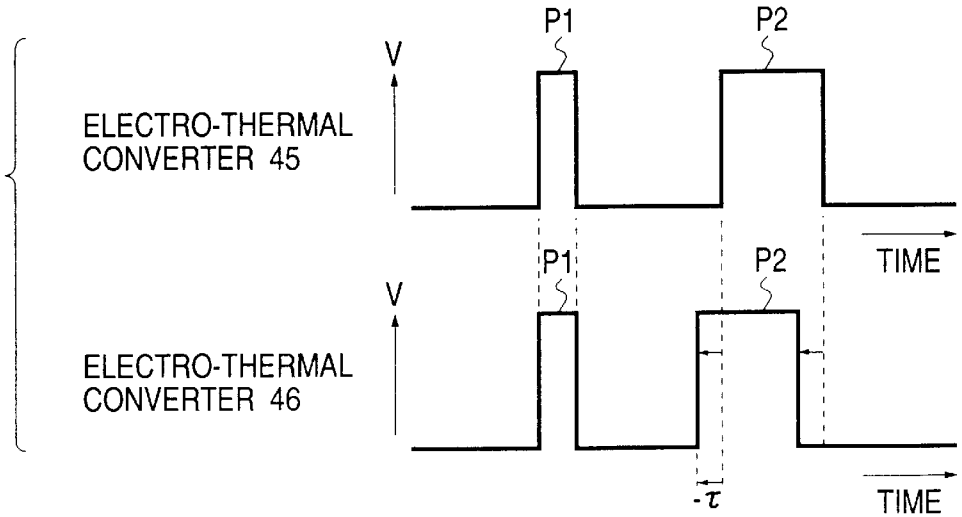
Figure 10:
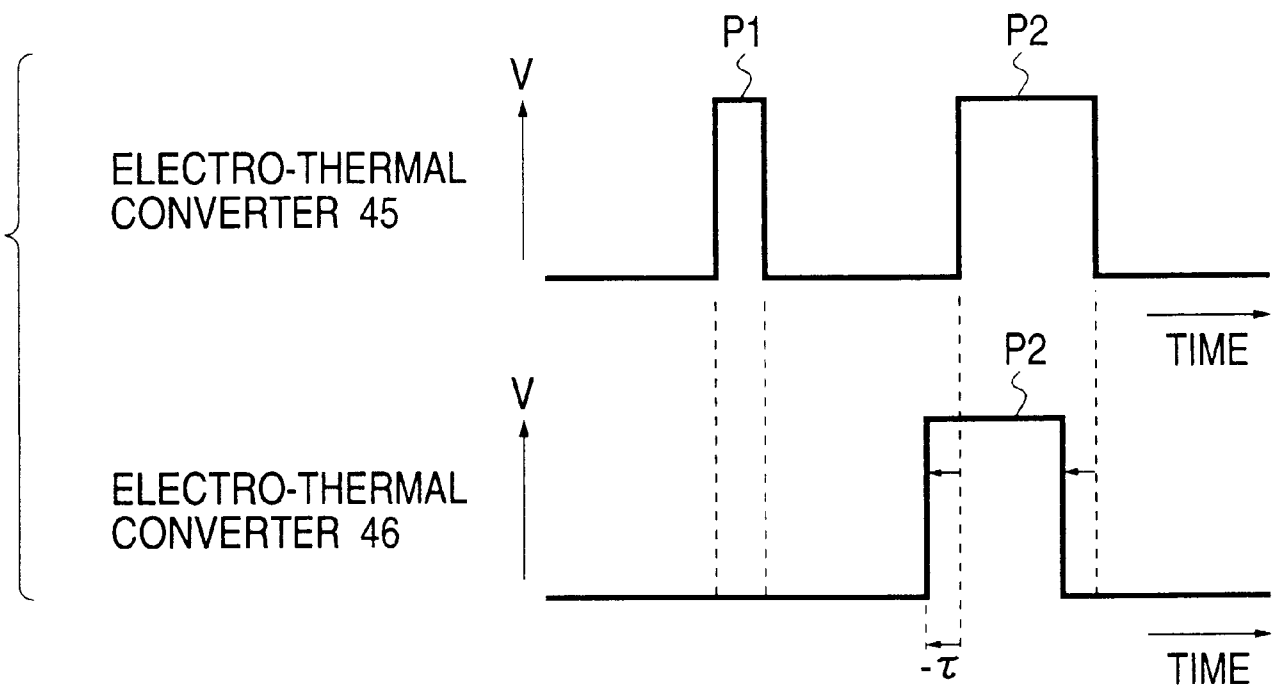
FIG. 10 is a view showing the wave forms which illustrate the time differential $\tau$.

Now, for the present embodiment, it is arranged as described above to execute such control as to shift the timing of the main pulses P2 applied to the electrothermal transducing elements 45 and 46 between them in order to control the variation between the discharge nozzles. As to the pre-pulse P1, the application is effectuated simultaneously in the same pulse width both for the electrothermal transducing elements 45 and 46. FIG. 9A shows an example in which the main pulse P2 is applied to one of the electrothermal transducing element 45 preceding the other one of them 46 by the time differential $\tau$. FIG. 9B shows an example in which the time differential is $-\tau$, that is, the main pulse P2 is applied to the other electrothermal transducing element 46 preceding one of them 45. Further, FIG. 10 shows a case where the time differential is $\tau$ between the main pulses P2 applied to both of the electrothermal transducing elements 45 and 46, but the pre-pulse P1 is applied only to one of the electrothermal transducing element 45, while no pre-pulse is applied to the other one of them 46. Depending on the time differential $\tau$ between the application timing of the main pulses P2, the discharge amount $V_d$ changes as shown in FIG. 5 as described earlier. Therefore, by setting an appropriate time differential $\tau$ corresponding to the variation of discharge amount between discharge nozzles, it is possible to suppress the variation of discharge amount caused by the individual difference between discharge nozzles. In this case, while defining the head temperature as the target temperature T when designing the temperature control, either the discharge amount per discharge nozzle or the dot diameter on a recording medium provided by discharged ink is measured or the time differential $\tau$ that makes the discharge amount or dot diameter constant is measured, and then, a table is prepared to indicate the time differential $\tau$ per discharge nozzle. This table is stored on the memory 25 provided for the head. The table 1 shows one example of such table as to indicate the time differential $\tau$ per discharge nozzle.

TABLE 1

| Nozzle No. | 1 | 2 | 3 | 4 | 5 | 6 | 7 | 8 | |
|---|---|---|---|---|---|---|---|---|---|
| Time differential $\tau$ ($\mu$sec) | 1.5 | 1.8 | 2.4 | 2.1 | 3.0 | 2.4 | 3.4 | 2.1 | . . . |

When printing, the time differential $\tau$ per discharge nozzle is read out from the table stored on the memory provided for the head of the ink jet head 2, and the application timing of the main pulse is caused to shift between the discharge nozzles by the time differential $\tau$ thus read out. In this way, the variation of discharge amount is suppressed between discharge nozzles.

Figure 11:
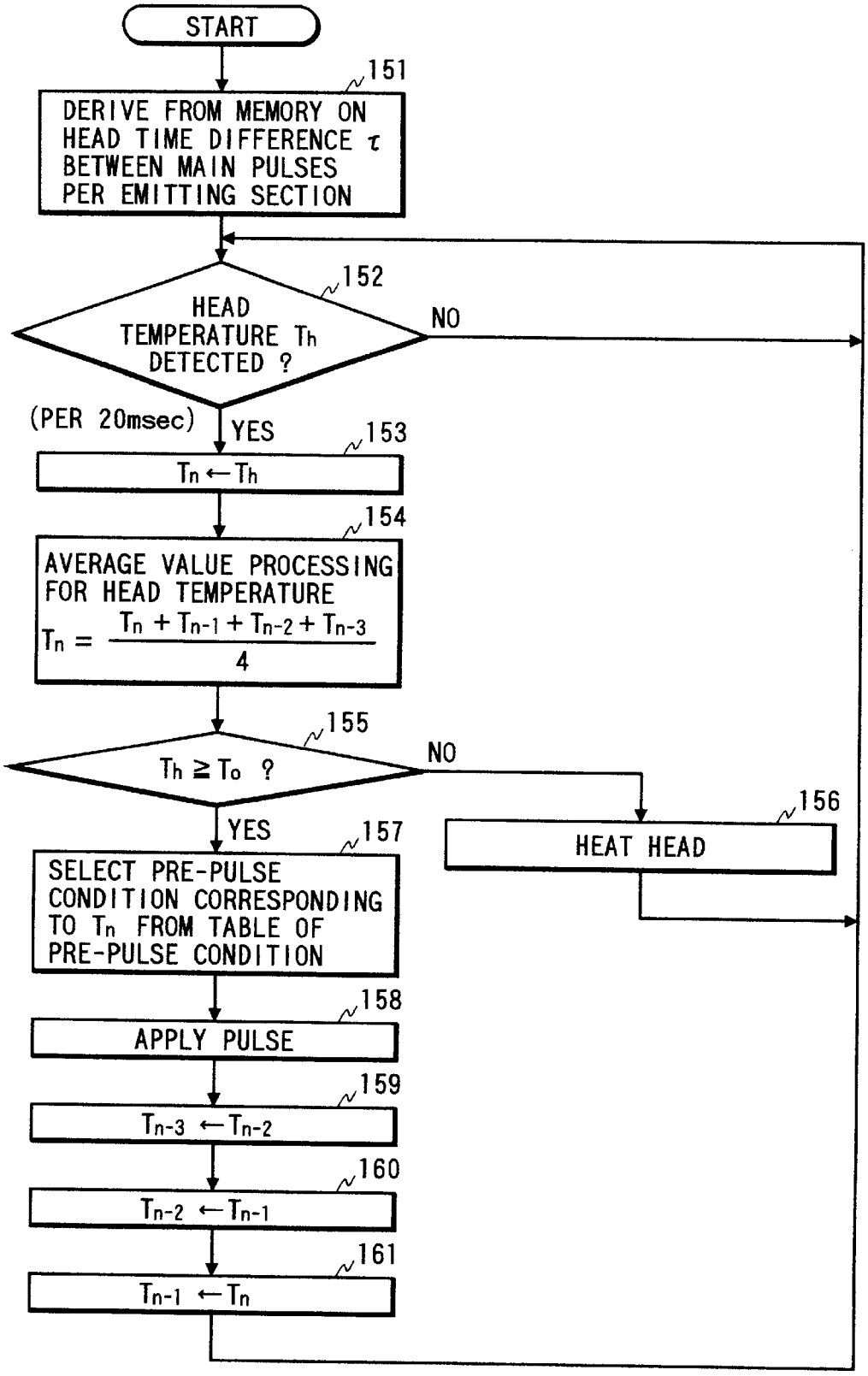
FIG. 11 is a flowchart which illustrate the discharge amount control in accordance with the first embodiment of the present invention.

FIG. 11 is a flowchart which shows the control procedures at the time of performing such control by means of time differential $\tau$ and also, the control by means of pre-pulse for the temperature control simultaneously. Here, the description will be made on the assumption that the head temperature is detected at intervals of 20 ms. At first, the time differential $\tau$ is obtained from the memory 25 on head per discharge nozzle (discharge unit) to set the time differential $\tau$ between the main pulses per discharge nozzle (step 151). Then, it is determined whether or not the head temperature $T_h$ is detected (step 152). When the head temperature $T_h$ is detected, the detected temperature is assigned to the variable $T_n$ that represents the head temperature for the present sampling (step 153). The head temperatures ($T_{n-3}$ to $T_n$) of the past 4-sampling portion is averaged to make them an averaged head temperature $T_n$ (step 154). After that, the target temperature of the temperature control (designed temperature) $T_o$ and the head temperature $T_n$ are compared (step 155). If the head temperature $T_n$ is not up to the target temperature $T_o$, the head is heated by means of the temperature heaters 30A and 30B (step 156). Then, the process returns to the step 152.

In the step 155, if the result of the comparison is $T_n \geqq T_o$, the pre-pulse condition is selected corresponding to the head temperature $T_n$ from the table that indicates pre-pulse conditions in order to perform the pre-pulse control on the basis of temperatures as described above (step 157), and then, the main pulses are applied to each of the discharge nozzles of the electrothermal transducing elements 45 and 46 (step 158). At this juncture, the pre-pulse condition is set as the one selected in the step 157, and at the same time, the timing of main pulses is caused to shift between one of the electrothermal transducing element 45 and the other one of them 46 per discharge nozzle in accordance with the time differential $\tau$ obtained in the step 151. Then, the time differential $\tau$ is defined as reference at the time of applying the main pulse to the one of the electrothermal transducing element 45, and also, the period of the off time for the pre-pulse control is regulated by means of one of the electrothermal transducing element 45. In this way, it becomes possible to obtain the compatibility of the off time control and the control using the time differential between the application timing of main pulses.

When the application of main pulse to each of the electrothermal transducing elements 45 and 46 is completed, the $T_{n-2}$ is assigned to the $T_{n-3}$ (step 159), the $T_{n-1}$ is assigned to the $T_{n-2}$ (step 160), and the $T_n$ is assigned to the $T_{n-1}$ (step 161) in order to average the head temperatures by adding in the newly measured value of the head temperature, and then, the process returns to the step 152.

Now, the description has been made of the first embodiment of the present invention. However, instead of storing the time differential τ itself on the memory 25 provided for the head, it may be possible to classify the time differentials τ into the ranks of several stages in advance as shown in the table 2, and then, to perform control in accordance with the time differential per rank.

TABLE 2

| Nozzle No. | 1 | 2 | 3 | 4 | 5 | 6 | 7 | 8 | |
|---|---|---|---|---|---|---|---|---|---|
| Rank No. | 2 | 3 | 2 | 5 | 4 | 3 | 4 | 2 | . . . |

In this case, such a corresponding table of the rank and time differential τ as shown in the table 3 is stored on the ROM 203 of the controller 200; on the memory 25 provided for the head; or in the driver software used for operating the ink jet printer.

TABLE 3

| Rank No. | 1 | 2 | 3 | 4 | 5 | 6 | |
|---|---|---|---|---|---|---|---|
| Time differential τ (μ sec) | 0 | 0.4 | 0.6 | 0.8 | 1.0 | 1.2 | . . . |

Here, the memory 25 on head will be described. As the memory 25 on head, an electronic circuit is arranged on the chip element, and it is generally practiced that wires are drawn around in the same manner as to draw wires around the electrothermal transducing elements for use of discharge. In this case, the data stored on the memory 25 provided for the head are read out as electric signals. Besides, the data may be read out by the various ways corresponding to the adopted methods, such as using a memory storing data magnetically or optically, or storing them in the irregular configuration, among some others.

In accordance with the embodiment described above, the discharge nozzle groups, which become the objects for the correction of variation brought about by the individual difference between discharge nozzles, are not necessarily limited to those within one and the same chip element. These objective nozzle groups may be present over a plurality of chip elements. On one independent ink jet head, one or plural chip elements are installed, and even when a plurality of such ink jet head are used, it is possible to control the variation of discharge amount by means of the method described above per discharge nozzle. Moreover, it may be possible to adjust the variation of discharge per chip element by means of the application of the time differential τ as described earlier.

Now, hereinafter, the description will be made of the example of an ink jet head using a plurality of chip elements.

Figure 12:
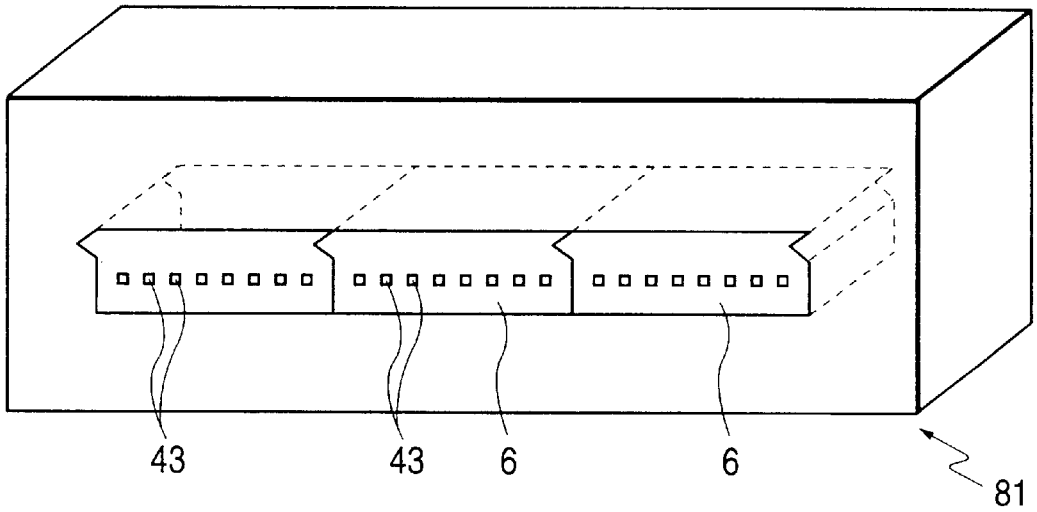
FIG. 12 is a perspective view which shows an elongated head.

FIG. 12 shows an elongated head 81 of a fully multiple head where a plurality of chip elements 6 are formed in one line in the arrangement direction of discharge nozzle array to provide many numbers of discharge ports 43.

Figure 13:
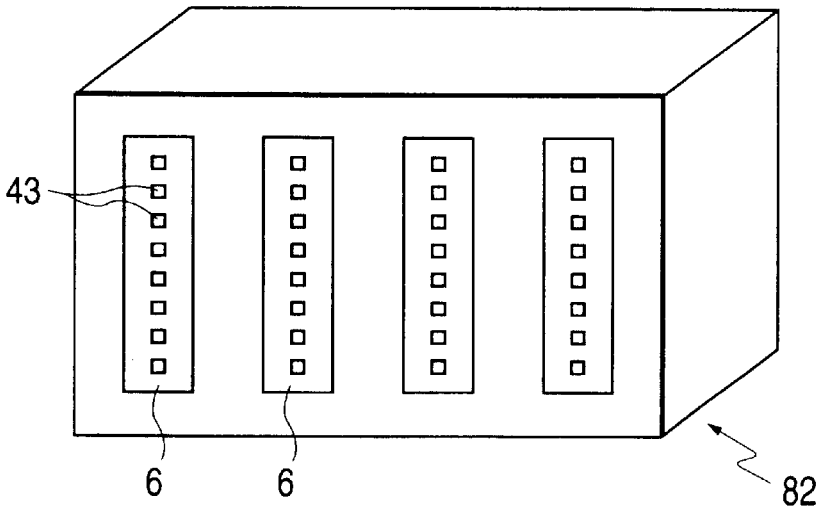
FIG. 13 is a perspective view which shows a head capable of using various kinds of ink.

FIG. 13 shows a head 82 for use of multiple kinds of ink prepared by arranging a plurality of chip elements 6 in the direction orthogonal to the direction of discharge nozzle arrays, thus making it possible to use the different chip element 6 for each of different kinds of ink, respectively.

Figure 14:
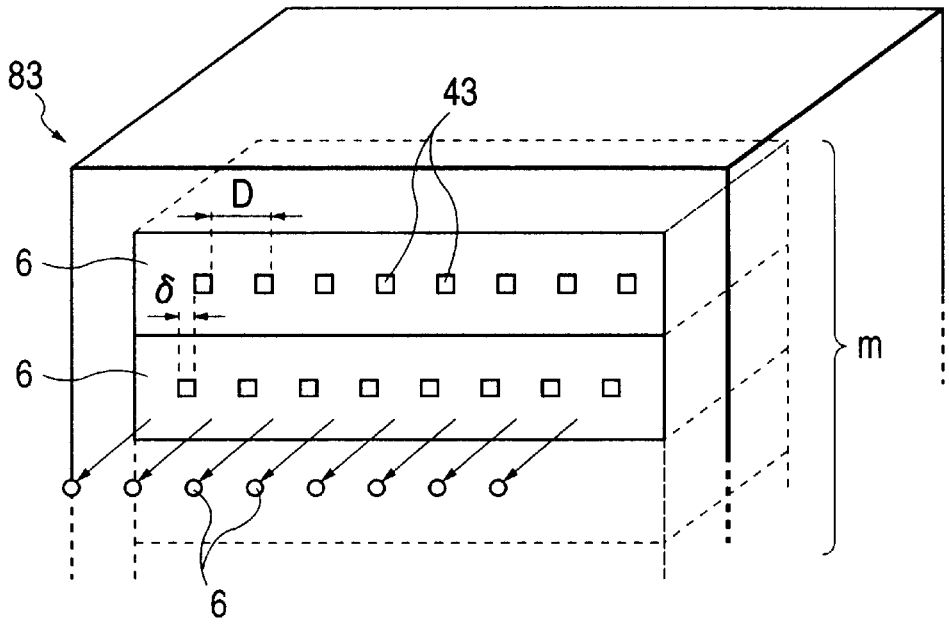
FIG. 14 is a perspective view which shows a high resolution head.

FIG. 14 shows a high resolution head 83 prepared by stacking a plurality of chip elements 6, each having pitches D between discharge ports 43, in mth number in the scanning direction, and also, by displacing the nozzle arrangement in an amount of δ (=D/n) between adjacent chip elements 6 in the top to bottom direction, thus making it possible to record in a high resolution of mn dots per unit length, which is n times the pitches of discharge ports 43. Here, the discharge amount of ink droplet 8 discharged from each of the discharge ports 43 is assumed to be an amount capable of obtaining the dot diameter corresponding to the recording resolution (mn dots per unit length) described above.

Figure 15:
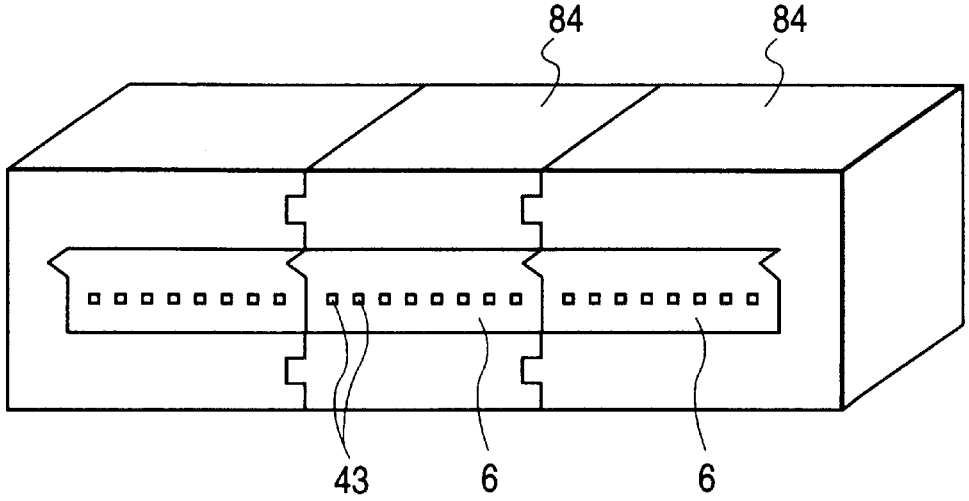
FIG. 15 is a perspective view which shows an ink jet head using independently sectional heads.

Further, FIG. 15 is a head structured by dividing a fully multiple head into a plurality of independently sectional heads 84 so that only the independent head 84, which presents malfunctions, such as disabled discharge, twisted discharge (that is, ink droplets are twisted when discharged), is replaced. Here, the number of discharge nozzles on the chip element 6 of each independently sectional head 84, and the number of chip elements 6 that constitute each of the independently sectional head 84 can be defined arbitrarily. Also, the configuration of contact surface between chip elements 6 and the independently sectional heads 84 may be made in any way if only such configuration makes it easy to position them.

Second Embodiment

Now, the description will be made of a second embodiment in accordance with the present invention.

As the structure of an ink jet head, a plurality of chip elements, each having a plurality of discharge nozzles, are often arranged to provide one head. In this respect, the variation of discharge amount tends to be smaller between discharge nozzles on one and the same chip element, and it becomes larger between chip elements. Here, a discharge control is performed by shifting the application timing of the main pulses in order to suppress the variation of discharge amount between chip elements for an ink jet recording apparatus that uses a plurality of chip elements, each having a discharge head structured as shown in FIGS. 4A and 4B.

Within one and the same chip element, one and the same time differential τ is used with respect to all the discharge nozzles as far as the timing of the main pulses is concerned. Also, the control by means of the pre-pulse is adopted as conventionally in use for controlling the variation of discharge amount caused by changes in the head temperature. Then, the head temperature is set at the designed target temperature $T_o$ in advance for the performance of the temperature control. After that, the averaged discharge amount per droplet per chip element or the diameter of a dot provided by discharged ink on a recording medium is measured or the time differential τ that enables the averaged discharge amount or dot diameter to become the target amount of the control is measured. Then, in accordance with the measured data, the table that indicates the time differential τ per chip element is prepared, and stored on the memory provided for the ink jet head. When printing, the application timing of the main pulses is caused to shift per chip element by the amount equal to the value of the time differential τ stored on the memory on head, hence eliminating the variation of discharge amount between chip elements.

As the ink jet head that uses a plurality of chip elements, there are an elongated head such as a fully multiple head, having a plurality of chip elements arranged in line in the direction of discharge nozzle array as shown in FIG. 12 to form many numbers of discharge nozzles; a head for use of many kinds of ink provided with different chip element per different kind of ink as shown in FIG. 13; a high resolution head having a plurality of chip elements which are stacked in the scanning direction, while being slightly displaced from each other as shown in FIG. 14, among some others. Also, as in the first embodiment, instead of the time differential τ itself being stored on the memory provided for the head, it may be possible to perform the control in accordance with the time differential τ per rank by classifying the time differentials into ranks of several stages in advance, which are stored on the memory on head. Also, one or plural chip elements are installed on an independently sectional head, and even when a plurality of such independently sectional heads are used, it is possible to adopt the method described above for the control thereof. The present embodiment is also applicable to such structure as to be arranged by dividing a fully multiple head into a plurality of independently sectional heads, hence making it possible to replace only the independently sectional head for which disabled discharge, twisted discharge, or other malfunction takes place.

Third Embodiment

For the first embodiment described above, the discharge amount control is made by means of the pre-pulse control with respect to the changes in the head temperature, and then, the time differential τ is set between main pulses when being applied to the two electrothermal transducing elements, thus suppressing the variation of discharge amount caused by the individual difference between the discharge nozzles. However, in accordance with a third embodiment of the present invention, the discharge amount control is performed by means of the time differential τ with respect to changes in the head temperature, while the pre-pulse control is adopted for suppressing the variation caused by the individual difference between discharge nozzles. Here, it is assumed to use an ink jet head having a plurality of discharge nozzles (discharge ports 43) as shown in FIGS. 4A and 4B, each having two electrothermal transducing elements 45 and 46 arranged in the ink path 42 of each of the discharge nozzles.

As described above, if the time differential τ is set for the application timing of the main pulses between the two electrothermal transducing elements 45 and 46 in one and the same ink path 42, the discharge amount $V_d$ is allowed to change. By shifting the application timing of main pulses in this way, it is possible to perform the discharge amount control as shown in FIG. 16 with respect to changes in the head temperature.

Figure 16:
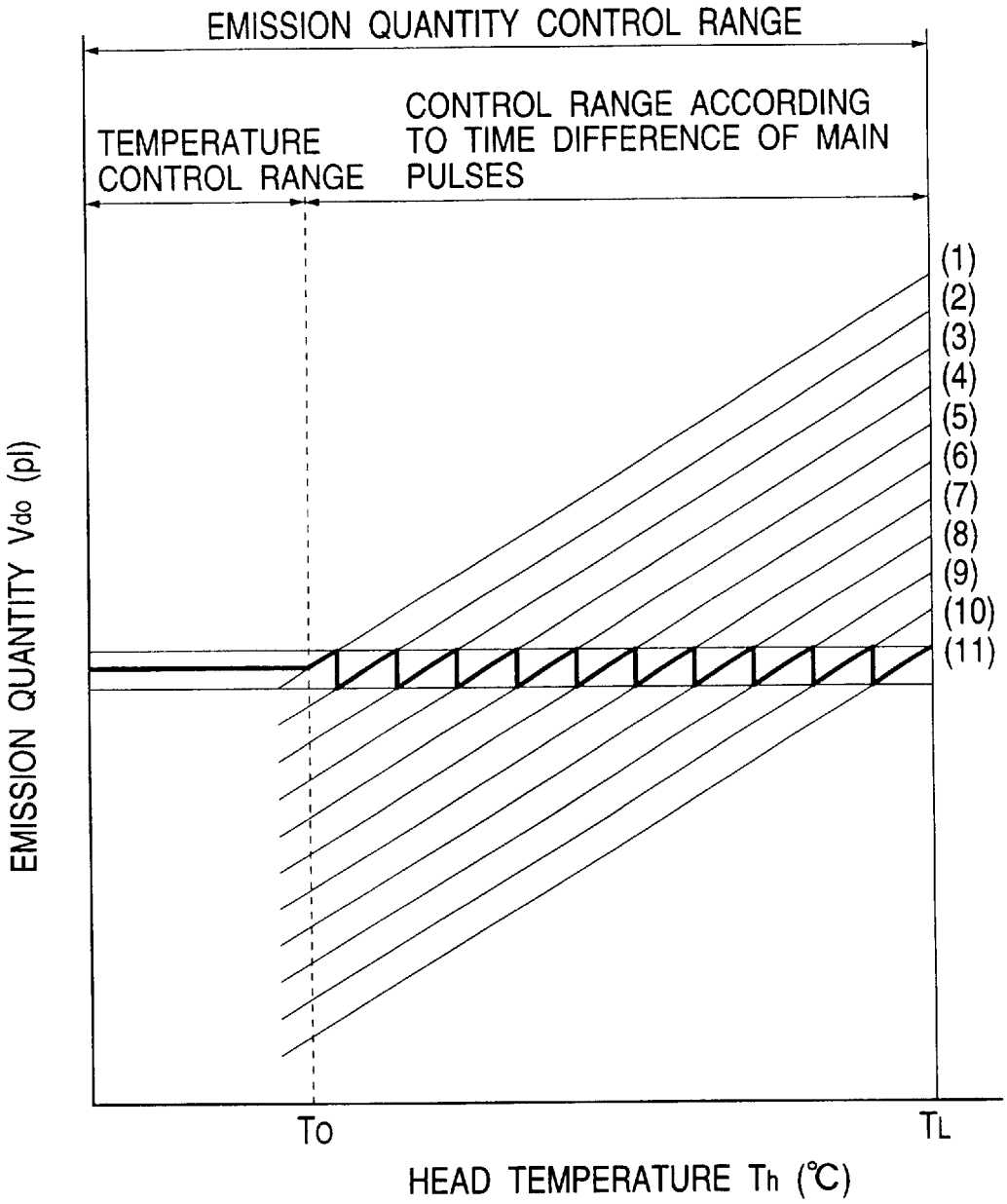
FIG. 16 is a graph which illustrates the discharge amount control corresponding to the head temperatures in accordance with a third embodiment of the present invention.

FIG. 16 is a view which illustrates the control of discharge amount with respect to changes in the head temperature. Given the target temperature of the temperature adjustment by means of the temperature heaters 30A and 30B as $T_o$, it is assumed that the adjustment of head temperature is executed by heat generated by the temperature heaters 30A and 30B within the range up to the temperature $T_o$ ("temperature adjustment range" indicated in FIG. 16). Also, in FIG. 16, each of the straight lines designated by numerals (1) to (11) indicates the relationship between the head temperature and the discharge amount from the discharge port 43, provided that the pre-pulse condition is constant, and it corresponds to the pre-pulse condition having the smaller absolute value of the time differential τ with the larger discharge amount in order of the smaller number. Here, therefore, the pre-pulse conditions are switched over to meet the head temperatures in order to keep the variation of the discharge amount within a specific width as indicated by thick lines in FIG. 16. More specifically, a table indicating the pre-pulse conditions applicable to each specific range of head temperatures is stored in advance as described later. Here, it is assumed that the temperature control is performed by heating the head up to the target temperature $T_o$ of the temperature control by means of temperature heater 30A and 30B or the like.

Also, preceding the main pulses, pre-pulse is applied to each of the electrothermal transducing elements 45 and 46, and then, by changing the width or off time of the pre-pulse, the discharge amount is controlled to suppress the variation of discharge amount between discharge nozzles. More specifically, the discharge amount per discharge nozzle or the dot diameter provided by the discharged ink on a recording medium is measured in advance with respect to the target temperature $T_o$ of the temperature control, or the pre-pulse condition, which makes the discharge amount or dot diameter constant, is measured per discharge nozzle, and then, the pre-pulse condition is stored on the memory 25 provided for the recording head in order to compensate the individual difference between discharge nozzles. At this juncture, the time differential τ is set at 0, and the pre-pulse condition is determined so as to enable the discharge amount at the target temperature $T_o$ to become the predetermined target value, or it may be possible to check in advance the time differential τ, which enables the pre-pulse control to eliminate the variation of discharge amount between discharge nozzles on one and the same chip element or over a plurality of chip elements, and then, to enable the discharge amount at the target temperature $T_o$ to become the target amount. This time differential τ is stored on the RAM 203 in the controller 200 of the printer or in the driver software for the operation of the memory of this ink jet printer.

With the execution of these measurements and the setting of the pre-pulse condition (including the setting of the time differential if the time differential τ is not set at 0 at the target temperature $T_o$), the variation of discharge amount is eliminated between discharge nozzles when the head temperature is at the target temperature $T_o$, and at the same time, the discharge amount from each of the discharge nozzles is made equal to the target amount.

Now, when operating an actual recording (printing), pulses are applied to the electrothermal transducing elements 45 and 46 in accordance recording data. Therefore, the head temperature is caused to rise above the target temperature $T_o$. In order not to cause the discharge amount to increase from each discharge port irrespective of such temperature rise, and also, to keep it to be equal to the discharge amount at the target temperature $T_o$, the absolute value of the time differential τ is allowed to increase accordingly as the temperature rises. The table, which indicates the appropriate time differential τ with respect to the temperatures that rise beyond the target temperature $T_o$ is stored in advance on the ROM 203 in the controller 200 of the printer or in the driver software for operating the memory of the ink jet printer.

When recording (printing), the time differential X is set for the main pulses in accordance with the result of the temperature detection by means of the temperature sensors 20A and 20B. At the same time, the pre-pulse condition stored on the memory 25 provided for the head is read out to apply the pre-pulse to each of the discharge nozzle in accordance with the stored condition thus read out. Then, with such execution of the pre-pulse control, and the setting of the shift in the timing of the main pulse application, the discharge amount becomes constant irrespective of the temperature rise of the head and the individual difference between discharge nozzles, hence making it possible to present the result of recording (printing) without any unevenness.

Here, for the present embodiment, instead of the value of the time differential $\tau$ itself, and the values of pulse width or off time themselves with respect to the pre-pulse control being stored on each of the memories, it may be possible to perform the control in accordance with the time differential $\tau$ and pre-pulse condition per rank by classifying time differentials and pre-pulse conditions into ranks of several stages in advance, which are made readable from each memory corresponding to the respective ranks.

For the embodiment described above, the discharge nozzle group, which is the object of correction of the variation caused by the individual difference between discharge nozzles, is not necessarily limited to those within one and the same chip element, but such object may include a plurality of chip elements. One or plural chip elements are installed on one independent ink jet head, and even when a plurality of such ink jet heads are used, it is possible to adopt the method described above for the control of the variation of discharge amount per discharge nozzle. As the ink jet head that uses a plurality of chip elements, there are an elongated head such as a fully multiple head, having a plurality of chip elements arranged in line in the direction of discharge nozzle array as shown in FIG. 12 for the formation of many numbers of discharge nozzles; a head for use of many kinds of ink provided with different chip element per different kind of ink as shown in FIG. 13; a high resolution head having a plurality of chip elements which are stacked in the scanning direction, while being slightly displaced from each other as shown in FIG. 14, among some others. Further, it is possible to perform the intended control with the method described above even for a plurality of independently sectional heads, each having one or plural chip elements installed on it. The present embodiment is also applicable to the structure arranged by dividing a fully multiple head into a plurality of independently sectional heads, hence making it possible to replace only the independently sectional head for which a malfunction takes place, such as disabled discharge, twisted discharge, among some others.

Fourth Embodiment

Now, the description will be made of a fourth embodiment in accordance with the present invention.

As the structure of an ink jet head, a plurality of chip elements, each having a plurality of discharge nozzles, are often arranged to provide one head. In this respect, the variation of discharge amount tends to be smaller between discharge nozzles on one and the same chip element, and it becomes larger between chip elements. Here, a discharge control is performed by shifting the application timing of the main pulses in order to suppress the variation of discharge amount caused by individual difference between chip elements for an ink jet recording apparatus that uses a plurality of chip elements, each having a discharge head structured as shown in FIGS. 4A and 4B. To this end, within one and the same chip element, one and the same pre-pulse condition is adopted for all the discharge nozzles. Then, for the discharge control with respect to changes in the head temperature, the control by means of the time differential $\tau$ of the application timing of main pulses is adopted for the two electrothermal transducing elements 45 and 46 arranged for the same nozzle. Here, it is assumed that the temperature is raised up to the target temperature $T_o$ designed for the temperature control by means of the temperature adjustment using the temperature heaters.

Then, the head temperature is set at the designed target temperature $T_o$ in advance for the temperature control. After that, the discharge amount per chip element or the diameter of a dot provided by discharged ink on a recording medium is measured or the pre-pulse condition that enables the discharge amount or dot diameter to become constant is measured. Then, the pre-pulse condition is stored on the memory provided for the head. At this juncture, it is possible to determine the pre-pulse condition so that the discharge amount at the target temperature $T_o$ becomes the predetermined target value on condition that the time differential $\tau$ is set at 0 or it may be possible to check in advance the time differential $\tau$, which enables the pre-pulse control to eliminate the variation of discharge amount between discharge nozzles on one and the same chip element or over a plurality of chip elements so as to allow the discharge amount to become the target amount at the target. temperature $T_o$. This time differential is stored on the ROM 203 in the controller 200 of the printer or in the driver software for operating the memory of the ink jet printer.

When printing, the pre-pulse control is performed per chip element in accordance with the pre-pulse condition stored on the memory provided for the head. Here, along the recording operation, the head temperature rises generally. With respect to this temperature rise, the absolute value of the time differential $\tau$ is made larger. With the performance of the control described above, it is possible to eliminate the variation of discharge amount caused by the individual difference between chip elements, and to make the discharge amount constant irrespective of the increase of the head temperature. As a result, recording is performed without any unevenness.

Here, for the present embodiment, instead of the value of the time differential $\tau$ itself, and the values of pulse width or off time themselves with respect to the pre-pulse control being stored on each of the memories, it may be possible to perform the control in accordance with the time differential $\tau$ and pre-pulse condition per rank by classifying time differentials and pre-pulse controls into ranks of several stages in advance, which are made readable from each memory corresponding to the respective ranks.

As the ink jet head that uses a plurality of chip elements, there are an elongated head such as a fully multiple head, having a plurality of chip elements arranged in line in the direction of discharge nozzle array as shown in FIG. 12 for the formation of many numbers of discharge nozzles; a head for use of many kinds of ink provided with different chip element per different kind of ink as shown in FIG. 13; a high resolution head having a plurality of chip elements which are stacked in the scanning direction, while being slightly displaced from each other as shown in FIG. 14, among some others. Further, it is possible to perform the intended control with the method described above even for a plurality of independently sectional heads, each having one or plural chip elements installed on it. The present embodiment is also applicable to the structure arranged by dividing a fully multiple head into a plurality of independently sectional heads, hence making it possible to replace only the independently sectional head for which a malfunction takes place, such as disabled discharge, twisted discharge, among some others.

Fifth Embodiment

For the present embodiment, the same ink jet head as described in conjunction with the first embodiment is used (see FIGS. 4A and 4B), and both the pre-pulse control and the control by means of shifting the timing of the main pulses are adopted for controlling the discharge amount. For each of the embodiments described above, the pre-pulse control is performed with respect to either one of the controls of the variation caused by changes in temperature and the variation between discharge nozzles (discharge nozzle groups), and the discharge amount control by means of the time differential $\tau$ is adopted for the other one of them. However, with the combination of these two discharge amount controls, it becomes possible to obtain a wider variable range of discharge amount practicably. More specifically, the time differential $\tau$ is maximized for the main pluses, while the minimum condition of discharge amount is set for the pre-pulse condition, and then, these are combined to present the minimum condition of discharge amount using these two method for controlling discharge amount. Also, on the contrary, the time differential $\tau$ for main pulses is set at 0, while the maximum condition of discharge amount is set for the pre-pulse condition, and then, these are combined to present the maximum condition of discharge amount using the two method for controlling discharge amount.

In this respect, for the present embodiment, the same method as described for the first embodiment to fourth embodiment is adopted with respect to the target temperature $T_o$ of the temperature control. Then, if the control, which is performed by either one of the method for shifting the timing of the main pulses used for the discharge amount control with respect to changes in temperature and the method for adopting the pre-pulse control, should reach the controllable limit due to the temperature rise, the remaining power of control still available by the other one of these methods is combined with the method currently in use in the temperature range beyond the limit of such controllable temperature. In this way, the discharge amount is prevented from being increased by use of both methods for controlling discharge amount accordingly.

FIG. 17 is a flowchart which shows the control procedures for the fifth embodiment in accordance with the present invention. Here, the pre-pulse control is performed for the control with respect to changes in head temperature, while the correction of variation between discharge nozzles is made by setting the time differential $\tau$. Here, the description is made on the assumption that the head temperature is detected at intervals of 20 ms. Also, the maximum head temperature, which enables the pre-pulse control to perform the discharge amount control, is given as $T_L$ (see FIG. 8). At first, in the same manner as the first embodiment, the time differential $\tau$ is read out from the memory 25 on head per discharge nozzle (discharge unit) to set the time differential of the main pulses per discharge nozzle (step 151). Then, it is determined whether or not the head temperature $T_h$ is detected (step 152). If affirmative, the detected temperature is assigned to $T_n$ that represents the head temperature of the current sampling (step 153). The head temperatures ($T_{n-3}$ to $T_n$) of the past 4-sampling portion is averaged to make them an averaged head temperature $T_n$ (step 154). After that, the target temperature of the temperature control (designed temperature) $T_o$ and the head temperature $T_n$ are compared (step 155). If the head temperature $T_n$ is not up to the target temperature $T_o$, the head is heated by means of the temperature heaters 30A and 30B (step 156). Then, the process returns to the step 152.

In the step 155, if the result of the comparison is $T_n \geqq T_o$, the pre-pulse condition is selected from the table that indicates pre-pulse conditions corresponding to the head temperature $T_n$ in order to perform the pre-pulse control on the basis of temperatures as described above (step 157), and then, it is determined whether or not the averaged head temperature $T_n$ is beyond the maximum temperature $T_L$ (to be exact, $T_L-1$), which is controllable by means of the pre-pulse control. If the head temperature does not reach the controllable maximum head temperature $T_L$, the process proceeds to step 158. If it has reached the temperature $T_L$, the increased portion corresponding to the value, which is obtainable by reducing the $T_L$ from the head temperature $T_n$ at that time, is added to the time differential $\tau$ per discharge nozzle, and then, such newly added value is set as a new time differential. Thus, the process proceeds to step 158. In other words, when the head temperature rises beyond the controllable limit of the pre-pulse control, the time differential is made larger in order to continue the discharge amount control with respect to such temperature rise.

In the step 158, the main pulses are applied to each of the discharge nozzles of the electrothermal transducing elements 45 and 46. At this juncture, the pre-pulse condition is set at the one selected in the step 157. At the same time, the time differential $\tau$ per discharge nozzle with respect to the main pulse timing is set at the time differential obtained in the step 151. In this respect, if the determination is affirmative in the step 121, and the process is allowed to proceed to the step 122, the time differential that is newly set in the step 122 is adopted here.

When the application of main pulse to each of the electrothermal transducing elements 45 and 46 is completed, the $T_{n-2}$ is assigned to the $T_{n-3}$ (step 159), the $T_{n-1}$ is assigned to the $T_{n-2}$ (step 160), and the $T_n$ is assigned to the $T_{n-1}$ (step 161) in order to average the head temperatures by adding in the newly measured value of the head temperature, and then, the process returns to the step 152.

The first embodiment to fifth embodiment described above are particularly important for a fully multiple ink jet head. Of the ink jet recording apparatuses, those of the serial type often perform printing by use of plural passes, and it is rear that the same line is printed by one discharge nozzle entirely. Therefore, even if there is variation of discharge amount between discharge nozzles, the influence of such variation is not concentrated on one part of a recording medium intensively. Such variation spreads over on the recording medium to make it less conspicuous after all. However, for the fully multiple head, the same line is printed entirely by one discharge nozzle fundamentally. Therefore, the variation of the discharge amount between discharge nozzles brings about the unevenness of prints as it is in the form of stripes on a recording medium. Also, since the same line is all printed by one discharge nozzle, the printing duty is caused to increase on a part of discharge nozzles when printing ruled lines or the like, and the temperature of such nozzles becomes higher to make it easier to increase discharge amount accordingly. Therefore, it is extremely important to suppress the variation of discharge amount between discharge nozzles.

Particularly, when intermediate gradation is represented by means of a dummy system or the like, it should be arranged to suppress not only the occurrence of density unevenness, but also, changes in color tone when printing in colors. Further, since the fully multiple head is long, the variation tends to take place between discharge nozzles for reasons related with its manufacture, and also, the variation of temperature becomes larger when the nozzles are in use. In addition, it is difficult to arrange one line of heads by use of a single chip element as the fully multiple head. Therefore, a plurality of chip elements should be used to structure such head. For reasons related with manufacture, properties of chip elements are caused to differ from each other, and also, the temperature of each chip element become different from each other in use. These tend to cause the variation of discharge amount. As a result, it is required to carry out temperature detection per chip element or per discharge nozzle, for controlling discharge amount with respect to changes in temperature. In order to measure the temperature per chip element, it may be possible to install the temperature sensor on each base plate (chip substrate) having electrothermal transducing elements arranged thereon or on the metallic base plate having the chip base plate arranged thereon, because these plates support a plurality of discharge nozzles, thus being in a state of presenting an almost averaged temperature thereof. However, in order to measure the temperature per discharge nozzle precisely, there is a need for the formation of such sensor on the wall surface that faces each of the discharge nozzles.

Sixth Embodiment

Here, using an ink jet head as shown in FIGS. 4A and 4B the discharge amount control only by means of shifting the application timing of main pulses is adopted for both of the discharge amount controls of variation of discharge amount caused by changes in temperature, and the variation of discharge amount between discharge nozzles. In accordance with the present embodiment, the variation of discharge amount is suppressed between discharge nozzles by means of the target temperature $T_o$ of the temperature control, and the time differential $\tau$, which enables the discharge amount to become the target amount, is checked in advance per discharge nozzle. Then, the table that indicates such time differential $\tau$ is stored on the memory 25 provided for the head. As to the rise of head temperature beyond the target temperature $T_o$ of the temperature control, it may be possible to arrange a table that indicates the time differential $\tau$ per discharge nozzle per head temperature, and store such table on the memory 25 provided for the head. However, since the volume of such information becomes enormous, a check is made to find an appropriate increase of value for the time differential $\tau$ corresponding to the temperature rise with respect to each time differential $\tau$ at the target temperature. Then, a table that indicates the relationship between such value thus checked and the referenced time differential is stored on the memory 25 provided for the head, on the ROM 203 in the controller 200 of the printer, or in the driver software for operating the memory of the ink jet printer. Here, it may be possible to execute the variation control per chip element, not necessarily per discharge nozzle.

For the present embodiment, it may be possible to stabilize discharge by use of pre-pulse. If the pre-pulse should be used, it is more effect to implement the combined use of the pre-pulse control as referred to in the first to fifth embodiments. However the present embodiment is particularly effective when it is desirable to avoid increasing the head temperature by use of pre-pulse. In accordance with the present embodiment, it is possible to suppress the temperature rise of the head by not using the pre-pulse. In this case, there is no need for the provision of any mechanism required for applying the pre-pulse.

Seventh Embodiment

For the first embodiment to sixth embodiment, densities are checked with respect to the prints obtainable by performing a solid printing, and dummy printing for intermediate gradation, among some others such as pattern printing per discharge nozzle or per chip element or per head or per discharge nozzle group for a plurality of continuous discharge nozzles or per discharge nozzle group belonging to the block of divisional driving. It is preferable to regulate the unit of such checks to the control unit with respect to the individual difference between discharge nozzles (discharge nozzle groups). However, the unit is not necessarily limited to such control. The discharge amount is controlled between discharge nozzles (groups) in accordance with the density information of prints per discharge nozzle (group) thus checked as described above instead of storing the information of the individual difference between discharge nozzles (groups) on the memory provided for the head or in the driver software of the printer as in the first embodiment to sixth embodiment. More specifically, the discharge amount is controlled to the target amount by means of a method for preparing a conversion table to obtain the discharge amount from the density of prints; a method for preparing a conversion table in which the correction amount is described for the discharge amount control based upon the density of prints; or a method for continuously operating printing and making density measurement simultaneously, while changing the discharge amounts until all the density of prints becomes a predetermined specific value. For means for controlling the discharge amount in such a manner, it is possible to adopt means for suppressing the variation between the discharge nozzles (groups) used for the first embodiment to sixth embodiment, that is, the controls by means of the pre-pulse control and the time differentials $\tau$ of the main pulse application as well.

Now, the present embodiment has been described. However, it may be possible for the present embodiment to arrange the control so as to suppress not only the variation between the discharge nozzle and the variation between chip elements, but also, the variation between discharge nozzle groups for a plurality of continuous discharge nozzles and the variation between the discharge nozzle groups belonging to the block of the divisional driving as the objects of the discharge amount control with respect to the variation caused by individual difference.

Now, the description will be made of a preferable position of the electrothermal transducing elements 45 and 46 in the ink path 42 of the ink jet head shown in FIGS. 4A and 4B.

Figure 18:
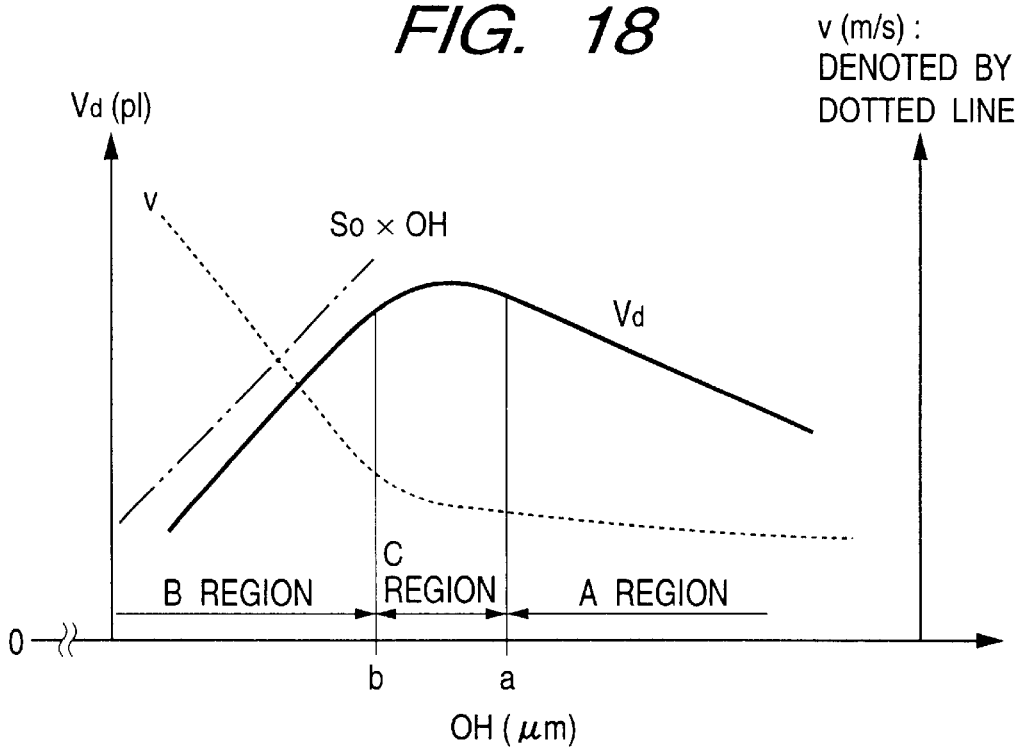
FIG. 18 is a view which shows both the relationship between the discharged amount $V_d$ of a droplet and the discharging speed v, and the relationship between the product of the discharge port area $S_o$ and the distance OH from the discharge port to the leading end of the heater, and the distance OH.
Figure 19:
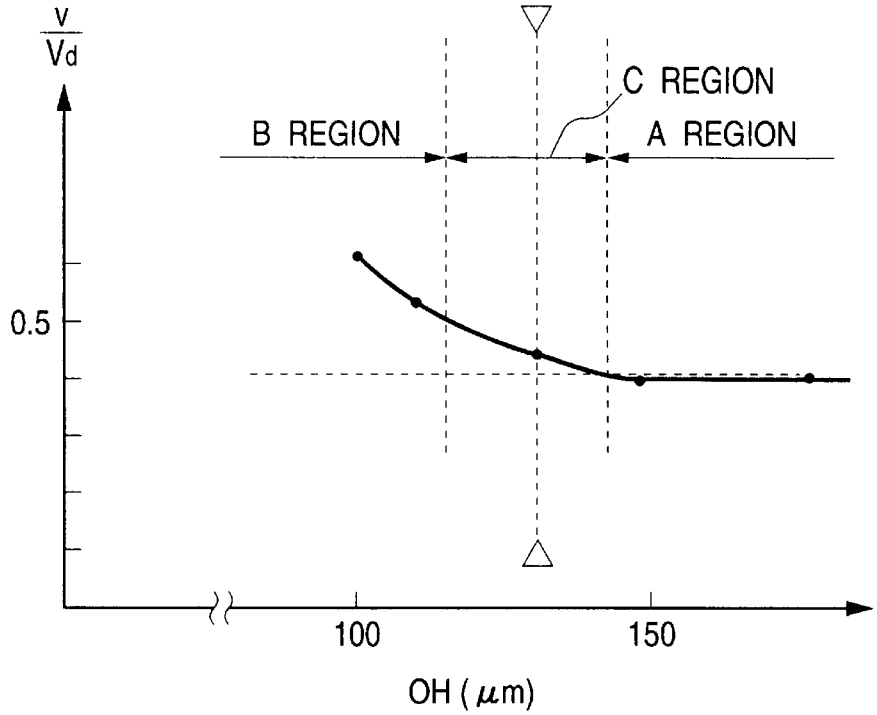
FIG. 19 is a view which shows the relationship between the result obtained by dividing the discharging speed v by the discharged amount $V_d$, and the distance OH.

FIG. 18 is a view which shows the relationship between the discharge amount $V_d$ of the droplet from the discharge port 43 and the discharging speed v of this droplet, and also, between the product of the area $S_O$ of the discharge port and the distance OH from the discharge port 43 to the leading end of the electrothermal transducing elements 45 and 46 (the leading end on the discharge port 43 side), and this distance OH. FIG. 19 is a view which shows the relationship between the result obtainable by dividing the discharging speed v by the discharge amount $V_d$ and the distance OH. In FIG. 18 and FIG. 19, singular points a and b are regulated, and the distance OH is divided into three areas, that is, an area A which is above a; an area B which is below b; and an area C which is between the a and b.

As the tendency characteristic to each of the areas, the discharging speed v and the discharge amount $V_d$ presents a substantially proportional relationship between them as the distance OH becomes larger in the area A, and it is possible to point out that the $v/V_d$ is almost constant; also, in the area B, the discharge amount $V_d$ is substantially proportional to the product of the area $S_O$ of the discharge port and the area OH; and in the area C, it is possible to point out that the discharge amount $V_d$ is almost constant. Also, each of the areas A to C described above may be defined as given below in consideration of the discharge amount $V_d$ and the discharging speed v, respectively.

(With a view given to the discharging speed v)

Area A: a zone where the discharge amount $V_d$ is reduced as the distance OH increases;

Area B: a zone where the discharge amount increases almost in proportion to the distance OH;

Area C: a zone where the discharge amount $V_d$ becomes almost constant with respect to the distance OH.

(With a view given to the discharging speed)

The discharging speed v is lowered as the distance OH becomes larger in all the zones, but in the area C, the amount of such change becomes more gradual.

As shown in FIG. 4B, when the two electrothermal transducing elements 45 and 46 are arranged to shift in the direction of the ink flow, it is preferable to position the electrothermal transducing element 45, which is on the front side (on the discharge port 43 side), on the area B or area C, while positioning the electrothermal transducing element 46 on the area A, in order to enhance the stability of the discharge amount and the shooting accuracy to a recording medium (which depends on the discharging speed v). In other words, it is preferable to arrange the structure so that the distance OH from the discharge port 43 to the leading end of the electrothermal transducing elements 45 and 46 on the discharge port 43 side corresponds to each of the areas described above, respectively.

In accordance with the present invention described above, it is possible to suppress the variation caused by the individual difference between discharge nozzles (groups) by means of the control that adopts the time differential $\tau$ in accordance with the data on the individual difference between discharge nozzles and or between discharge nozzle groups. In particular, for the present invention, the control by means of pre-pulse and the control by means of the time differential $\tau$ are used together, and one of them is used for suppressing the variation of discharge amount caused by changes in the temperature of ink and the other one of them is used for suppressing the variation of discharge amount caused by the individual difference between discharge nozzles (groups). In this way, even when either one of the variations caused by changes in ink temperature and by the individual difference between discharge nozzles (groups) or both of them are so large that a sufficient controllable range cannot be obtained just by means of either one of the control methods, it is possible to obtain a wider controllable range by the combined use of both controls, and also, to maintain the discharge amount at a constant value, thus making recording possible to obtain images of a higher quality.

What is claimed is:

1. An ink jet apparatus provided with an ink jet head provided with plural nozzles at least two of which each have a plurality of electrothermal transducing elements arranged to create air bubbles for discharging ink and to be driven individually, the ink jet apparatus comprising:

temperature detection means for detecting temperatures of the ink jet head;

data storing means for storing correction data to correct a variation of discharge amount between discharge nozzles or between discharge nozzle groups;

driving means for applying driving signals, each including a main pulse to enable the electrothermal transducing elements to generate thermal energy for the creation of bubbles, a pre-pulse preceding the main pulse for heating in a manner not intensive enough to create any bubbles, and a quiescent time between the main pulse and the pre-pulse, in accordance with recording data; and controlling means for performing a first control to change the conditions of the pre-pulse in accordance with data stored in said data storing means, and also performing a second control to shift an application timing of main pulses between electrothermal transducing elements in each of one or more nozzles, wherein the first control is performed in accordance with the result of the detection by said temperature detection means to suppress a variation of discharge amount caused by changes in the temperature of ink, and the second control is performed in accordance with the data stored in said data storing means to suppress the variation of discharge amount caused by individual difference between discharge nozzles or discharge nozzle groups.

2. An ink jet apparatus provided with an ink jet head provided with plural nozzles at least two of which each have a plurality of electrothermal transducing elements arranged to create air bubbles for discharging ink and to be driven individually, the ink jet apparatus comprising:

temperature detection means for detecting temperatures of the ink jet head;

data storing means for storing correction data to correct a variation of discharge amount between discharge nozzles or between discharge nozzle groups;

driving means for applying driving signals, each including a main pulse to enable the electrothermal transducing elements to generate thermal energy for the creation of bubbles, a pre-pulse preceding the main pulse for heating in a manner not intensive enough to create any bubbles, and a quiescent time between the main pulse and the pre-pulse, in accordance with recording data; and controlling means for performing a first control to change the conditions of the pre-pulse in accordance with data stored in said data storing means, and also performing a second control to shift an application timing of main pulses between electrothermal transducing elements in each of one or more nozzles, wherein the second control is performed in accordance with the result of the detection by said temperature detection means to suppress a variation of discharge amount caused by changes in the temperature of ink, and the first control is performed in accordance with the data stored in said data storing means to suppress the variation of discharge amount caused by individual difference between discharge nozzles or discharge nozzle groups.

3. An ink jet apparatus according to claim 1 or claim 2, wherein heating means is provided to heat the ink jet head, and when the detected temperature by said temperature detection means is lower than a specific target temperature, a temperature adjustment is performed by said heating means to raise a temperature of the ink jet head to reach the target temperature.

4. A method for driving an ink jet head provided with a plurality of discharge nozzles and a plurality of electrothermal transducing elements for bubble creation, each electrothermal transducing member being arranged corresponding to each of the plurality of discharge nozzles, by applying a main pulse for applying a bubble creation energy and by applying a pre-pulse preceding the main pulse for heating in a manner not intensive enough to create any bubbles so that an ink liquid droplet is discharged from the discharge nozzles by the bubble creation, the method comprising the steps of:

executing a first control by changing an application condition of the pre-pulse in accordance with a detected temperature of the ink jet head together with executing a second control for suppressing a variation of discharge amount due to an individual difference among the discharge nozzles or discharge nozzle groups by adjusting a time difference of an application start of the main pulse for bubble creation among the plurality of electrothermal transducing elements in the discharge nozzles; and suppressing a variation of discharge amount due to a temperature change of the ink by combining the first control with the second control in a case where the detected temperature of ink jet head exceeds a controllable limit temperature of the first control.

5. A method for driving an ink jet head provided with a plurality of discharge nozzles and a plurality of electrothermal transducing elements for bubble creation, each electrothermal transducing member being arranged corresponding to each of the plurality of discharge nozzles, by applying a main pulse for applying a bubble creation energy and by applying a pre-pulse preceding the main pulse for heating in a manner not intensive enough to create any bubbles so that an ink liquid droplet is discharged from the discharge nozzles by the bubble creation, the method comprising the steps of:

executing a first control by changing an application condition of the pre-pulse in accordance with a detected temperature of the ink jet head together with executing a second control for suppressing a variation of discharge amount due to an individual difference among the discharge nozzles or discharge nozzle groups by adjusting a time difference of an application start of the main pulse for bubble creation among the plurality of electrothermal transducing elements in the discharge nozzles; and suppressing a variation of discharge amount due to a temperature change of the ink by combining the first control with the second control in a case where the detected temperature of the ink jet head exceeds a controllable limit temperature of the second control.

6. A method according to claim 4 or claim 5, wherein two electrothermal transducing elements are provided per each discharge nozzle, and are arranged in a direction intersecting an ink flow direction toward the discharge nozzle, and the application timing of the main pulses to each of the two electrothermal transducing elements is shifted.

7. A method according to claim 4 or claim 5, wherein two electrothermal transducing elements are provided per each discharge nozzle, and arranged within each discharge nozzle in the direction intersecting an ink flow direction toward the discharge nozzle, and are arranged within each discharge nozzle shifted relatively within the length of the electrothermal transducing element in the direction of ink flow, and the application timing of the main pulses to each of the two electrothermal transducing elements is caused to shift.

8. A method according to claim 4 or claim 5, wherein the ink jet head is an elongated head structured by chip elements, each having a plurality of discharge nozzles, and the chip elements are arranged in one line in an arrangement direction of discharge ports of the discharge nozzles.

9. A method according to claim 4 or claim 5, wherein the ink jet head is a head structured by use of a plurality of chip elements, each having a plurality of discharge nozzles, for use of different colors or kinds of ink.

10. A method according to claim 4 or claim 5, wherein the ink jet head is a high resolution head structured by a plurality of chip elements, each having a plurality of discharge nozzles at equal intervals, and the chip elements are stacked while being displaced by pitches corresponding to a recording resolution.

11. A method according to claim 4 or claim 5, wherein the variation of a discharge amount caused by the individual difference between discharge nozzles or discharge nozzle groups is detected by reading out a density unevenness of prints, and the control of discharge amount is performed to eliminate the density unevenness.

* * * * *

UNITED STATES PATENT AND TRADEMARK OFFICE

CERTIFICATE OF CORRECTION

PATENT NO. : 6,511,145 B1
DATED : January 28, 2003
INVENTOR(S) : Hitoshi Tsuboi et al.

It is certified that error appears in the above-identified patent and that said Letters Patent is hereby corrected as shown below:

Column 1,
Line 24, “printer,” should read -- printer or --.

Column 5,
Line 19, “illustrate” should read -- illustrates --.

Column 6,
Line 14, “garage” should read -- garage 110*b* --; and
Line 51, “portions-of” should read -- portions of --.

Column 9,
Line 51, “main pluses,” should read -- main pulses, --.

Column 10,
Line 12, “large” should read -- larger --.

Column 16,
Line 66, “X” should read -- $\tau$ --.

Column 18,
Line 28, “target.” should read -- target --.

Signed and Sealed this

Twelfth Day of August, 2003

JAMES E. ROGAN
*Director of the United States Patent and Trademark Office*